United States Patent [19]

Hanatani et al.

[11] Patent Number: 4,925,759

[45] Date of Patent: May 15, 1990

[54] ELECTROPHOTOGRAPHIC SENSITIVE MATERIAL WITH PYRROLOPYRROLE AND BENZIDINE DERIVATIVES

[75] Inventors: Yasuyuki Hanatani; Kaname Nakatani, both of Osaka, Japan

[73] Assignee: Mita Industrial Co., Ltd., Osaka, Japan

[21] Appl. No.: 399,410

[22] Filed: Oct. 5, 1989

Related U.S. Application Data

[63] Continuation-in-part of Ser. No. 276,578, Nov. 28, 1988, abandoned.

[30] Foreign Application Priority Data

Nov. 30, 1987 [JP] Japan ..... 62-301855

[51] Int. Cl.[5] ..... G03G 5/06; G03G 5/14

[52] U.S. Cl. ..... 430/59; 430/78

[58] Field of Search ..... 430/59, 76, 78

[56] References Cited

U.S. PATENT DOCUMENTS 4,047,948 9/1977 Horgan ..... 430/59

4,632,893 12/1986 Rochat et al. ..... 430/58

*Primary Examiner*—Roland E. Martin

*Attorney, Agent, or Firm*—Beveridge, DeGrandi & Weilacher

[57] ABSTRACT

An electrophotographic sensitive material is provided which has a photosensitive layer formed on an electroconductive substrate, the photosensitive layer containing a pyrrolopyrrole type compound represented by the following genral formula (1) and a benzidine derivative represented by the following general formula (2)

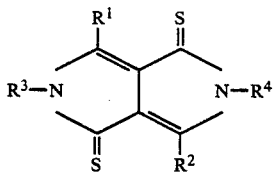

(1)

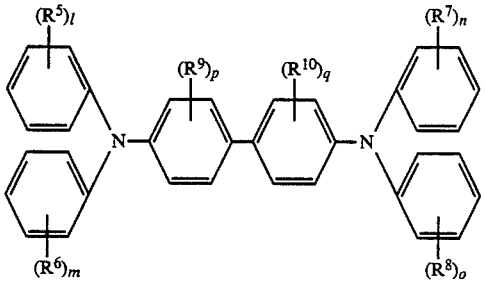

(2)

In the general formulas (1) and (2), $R^1$, $R^2$, $R^3$, $R^4$, $R^5$, $R^6$, $R^7$, $R^8$, $R^9$, $R^{10}$, l, m, n, o, p and q have the same meanings as defined in the text of the specification.

12 Claims, No Drawings

ELECTROPHOTOGRAPHIC SENSITIVE MATERIAL WITH PYRROLOPYRROLE AND BENZIDINE DERIVATIVES

This is a continuation-in-part of co-pending Ser. No. 07/276,578 filed Nov. 28, 1988, now abandoned.

BACKGROUND OF THE INVENTION

This invention relates to an electrophotographic sensitive material useful advantageously in an image-forming apparatus such as the copying machine.

In recent years, as electrophotographic sensitive materials for use in such image-forming apparatuses as copying machines, sensitive materials of the kind permitting a wide freedom in design of functions have been proposed.

Particularly, electrophotographic sensitive materials possessed of a photosensitive layer of the separate function type containing an electric charge generating material capable of generating electric charge upon exposure to light and an electric charge transferring material capable of transferring generated electric charge in one or two layers have been proposed. For example, electrophotographic sensitive materials possessed of a single-layer type photosensitive layer containing an electric charge generating material, an electric charge transferring material, and a binding resin in one layer and electrophotographic sensitive materials possessed of a laminate type photosensitive layer formed by superposition of an electric charge generating layer containing an electric charge generating material on an electric charge transferring layer containing an electric charge transferring material and a binding resin have been proposed.

In the formation of a copied image by the use of an electrophotographic sensitive material, the Carlson process is popularly utilized. The Carlson process basically comprises a charging step for uniformly charging a sensitive material by corona discharge, an exposing step for exposing the charged sensitive material through a given original image to light thereby forming on the sensitive material an electrostatic latent image conforming to the original image, a developing step for developing the electrostatic latent image with a developer containing a toner thereby forming a toner image, a transferring step for causing the toner image to be transferred onto a substrate such as paper, a fixing step for fixing the toner image transferred on the substrate, and a cleaning step for removing the toner remaining on the sensitive material after the transferring step. For the image to be produced with high quality in the Carlson process, the electrophotographic sensitive material is required to excel in the charging property and the photosensitive property and, at the same time, to be low in residual potential after the exposure to light.

The electrophotographic properties of the electrophotographic sensitive material of the separate function type mentioned above are affected in a large measure by the combination of an electric charge generating material and an electric charge transferring material. For example, an electrophotographic sensitive material possessed of a photosensitive layer using a pyrrolopyrrole type compound proposed as an electric charge generating material U.S. Pat. No. 4,632,893 in combination with a hydrazone type compound such as N-ethyl-3-carbazolylaldehyde-N,N-diphenyl hydrazone which depends heavily for drift mobility upon the intensity of electric field is high in residual potential and is deficient in sensitivity. The hydrazone type compound has no sufficient stability to resist light because it is liable to be isomerized and dimerized on exposure to light. The sensitive material, therefore, has a disadvantage that it suffers from gradual decrease of sensitivity and gradual increase of residual potential through repeated rounds of printing.

A sensitive material which uses a phthalocyanine type compound as an electric charge generating material in combination with a styryl triphenylamine type compound represented by 4-styryl-4'-methoxy triphenylamine, 4-(4-methylstyryl)-4'-methyl triphenylamine, or 4-(3,5-dimethylstyryl)-4'-methyl triphenylamine as an electric charge transferring material has been proposed (Publication for unexamined Japanese Patent Application Disclosure No. 115,167/1987).

The sensitive material possessed of a photosensitive layer containing a styryl triphenylamine type compound generally excels in electrical properties and sensitive properties as compared with the sensitive material containing other electric charge transferring material.

The styryl triphenylamine type compound, however, exhibits no sufficient compatibility with a binding resin, possesses a small capacity for electron donation, and betrays its deficiency in the electric charge transferring property. The sensitive material which is produced by using the styryl triphenylamine type compound, therefore, has a disadvantage that the charging property and the sensitivity are short of sufficiency and the residual potential is unduly high.

SUMMARY OF THE INVENTION

This invention aims to provide an electrophotographic sensitive material which excels in stability to resist light, charging property, and photosensitive property.

The electrophotographic sensitive material contemplated by the present invention is a sensitive material having a photosensitive layer formed on an electroconductive substrate and is characterized by the fact that the sensitive material contains a pyrrolopyrrole type compound represented by the following general formula (1) and a benzidine derivative represented by the following general formula (2).

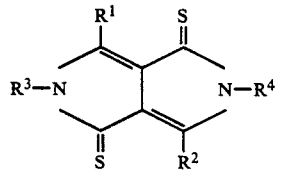

(1)

(wherein $R^1$ and $R^2$ independently stand for an aryl group which may contain a substituent, an aralkyl group which may contain a substituent, or a heterocyclic group and $R^3$ and $R^4$ independently stand for a hydrogen atom, an alkyl group, or an aryl group which may contain a substituent).

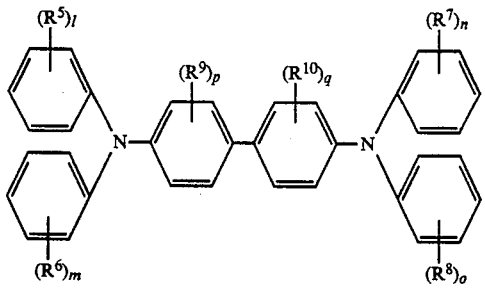

(2)

(wherein $R^5$, $R^6$, $R^7$, $R^8$, $R^9$ and $R^{10}$ independently stand for a hydrogen atom, a lower alkyl group, a lower alkoxy group, or a halogen atom, l, m, n, and o each stand for an integer in the range of 1 to 3, and p and q each stand for 1 or 2).

The electrophotographic sensitive material contemplated by the present invention has a photosensitive layer formed on an electroconductive substrate. This photosensitive layer contains a pyrrolopyrrole type compound represented by the aforementioned general formula (1) and a benzidine derivative represented by the aforementioned general formula (2).

The electroconductive substrate may be in the form of a sheet or in the form of a drum. As regards the material of the electroconductive substrate, the substrate itself may be made of a material possessed of electroconductivity or the substrate made of a material not possessed of electroconductivity may be endowed on the surface thereof with electroconductivity. The electroconductive substrate is desired to manifest high mechanical strength at the time of its use. Various materials possessed of electroconductivity are available for the production of the electroconductive substrate meeting the description given above. Simple metals such as aluminum, copper, tin, platinum, gold, silver, vanadium, molybdenum, chromium, cadmium, titanium, nickel, palladium, indium, stainless steel, and brass; plastic materials having these metals vacuum deposited or superposed thereon; and glass sheets coated with aluminum iodide, tin oxide, or indium oxide may be cited as concrete examples. In these materials which are available for the electroconductive substrate, aluminum is used desirably for the purpose of preventing occurrence of black spots and pinholes in a copied image and, at the same time, enhancing the tightness of adhesion between the photosensitive layer and the substrate. The aluminum which has undergone electrolysis in an oxalic acid solution and which consequently has no crystal particles of aluminum retained on the surface thereof is used especially desirably for this purpose. The aluminum which, in consequence of the electrolysis, has been provided with an oxide coating 5 to 12 μm in thickness and no more than 1.5 μm in surface roughness is used most advantageously for the purpose.

As concrete examples of the aryl group of $R^1$ and $R^2$ in the general formula (1) of the pyrrolopyrrole type compound to be contained in the photosensitive layer, phenyl group, naphthyl group, anthryl group, phenanthryl group, fluorenyl group, and 1-pyrenyl group may be cited. Among other aryl groups mentioned above, the phenyl group or the naphthyl group is particularly desirable. The phenyl group is most desirable.

As concrete examples of the aralkyl group, there may be cited benzyl group (phenylmethyl group), phenylethyl group, and naphthylmethyl group.

The substituent in the aryl group or the aralkyl group may be selected from the class consisting of halogen atoms, lower alkyl groups containing a halogen atom, a cyano group, alkyl groups, alkoxy groups, and dialkylamino group, for example.

The halogen atoms include fluorine, chlorine, bromine, and iodine, for example. Among other halogen atoms mentioned, chlorine or bromine atom is desirable.

As concrete examples of the alkyl group containing a halogen atom, there may be cited chloromethyl group, dichloromethyl group, trichloromethyl group, 2-chloroethyl group, 2,2-trichloroethyl group, 2,2,2-trichloroethyl group, and trifluoromethyl group.

As concrete examples of the alkyl group, there may be cited such alkyl groups as methyl group, ethyl group, propyl group, isopropyl group, butyl group, isobutyl group, tert-butyl group, pentyl group, hexyl group, heptyl group, octyl group, nonyl group, decyl group, undecyl group, dodecyl group, and stearyl group which have 1 to 18 carbon atoms. In the alkyl groups mentioned above, linear or branched alkyl groups having 1 to 12 carbon atoms are desirable, linear or branched lower alkyl groups having 1 to 6 carbon atoms are more desirable, and linear or branched lower alkyl groups having 1 to 4 carbon atoms are most desirable.

As concrete examples of the alkoxy group, there may be cited methoxy group, ethoxy group, propoxy group, isopropoxy group, butoxy group, isobutoxy group, tert-butoxy group, pentyloxy group hexyloxy group heptyloxy group, octyloxy group, nonyloxy group, decyloxy group, undecyloxy group, dodecyloxy group, and stearyloxy group. In the alkoxy groups mentioned above, linear or branched alkoxy groups having 1 to 12 carbon atoms are desirable, linear or branched lower alkoxy groups having 1 to 6 carbon atoms are more desirable, and linear or branched lower alkoxy groups having 1 to 4 carbon atoms are most desirable.

As concrete examples of the dialkylamino group, there may be cited such dialkylamino groups as dimethylamino, diethylamino, methylethylamino, dipropylamino, diisopropylamino, dibutylamino, diisobutylamino, di-tert-butylamino, dipentylamino, and dihexylamino groups which have an alkyl moiety of 1 to 6 carbon atoms.

As concrete examples of the heterocyclic group, there may be cited thienyl, thianthrenyl, furyl, pyranyl, isobenzofuranyl, chromenyl, xanthenyl, phenoxazinyl, pyrrolyl, imidazolyl, pyrazolyl, isothiazolyl, isooxazolyl, indolysinyl, isoindolyl, indolyl, indazolyl, purinyl, pyridyl, pyrazinyl, pyrimidyl, pyridazinyl, quinolidinyl, isoquinolyl, quinolyl, phthalazinyl, naphthylidinyl, quinoxalinyl, quinazolinyl, cinnolinyl, pteridinyl, carbazolyl, carbonylyl, phenanthridinyl, acridinyl, perimidinyl, phenanthrolinyl, phenazinyl, phenarsazinyl, phenothiazinyl, furazanyl, phenoxazinyl, isochromanyl, chromanyl, pyrrolidinyl, pyrrolinyl, imidazolidinyl, imidazolinyl, pyrazolidinyl, pyrazolinyl, piperidyl, piperidino, piperazinyl, indolinyl, isoindolinyl, quinuclidinyl, morpholinyl, and morpholino groups, and the condensed heterocyclic groups of the condensed heterocyclic type compounds by the ortho-condensation or peri-condensation of compounds containing the heterocyclic groups mentioned above with an aryl compound. As concrete examples of the alkyl group of $R^3$ and $R^4$ in the general formula (1) of the pyrrolopyrrole type compound to be contained in the photosensitive layer, there may be cited, in the lower alkyl groups cited above with respect to the substituents $R^1$ and $R^2$, those lower alkyl groups having 1 to 6 carbon atoms, preferably the alkyl groups of 1 to 4 carbon atoms.

The aryl groups containing a substituent are desired to be substituted phenyl groups. The substituent is desired to be selected from the class consisting of halogen atoms, lower alkyl groups containing a halogen atom, alkyl groups, alkoxy groups, alkylthio groups, and nitro groups. As concrete examples of the halogen atoms, the lower alkyl groups containing a halogen atom, the alkyl groups, and the alkoxy groups, there may be cited the same substituents as cited above with respect to $R^1$ and $R^2$. As concrete examples of the alkylthio group, there may be cited methylthio group, ethylthio group, propylthio group, isopropylthio group, butylthio group, isobutylthio group, tert-butylthio group, pentylthio group, hexylthio group, heptylthio group, octylthio group, nonylthio group, decylthio group, undecylthio group, dodecylthio group, and stearylthio group. In the alkylthio groups mentioned above, linear or branched alkylthio groups having 1 to 12 carbon atoms are desirable, linear or branched lower alkylthio groups having 1 to 6 carbon atoms are more desirable, and linear or branched lower alkylthio groups having 1 to 4 carbon atoms are most desirable.

It is especially desirable that the substituents $R^3$ and $R^4$ are both a hydrogen atom.

In the pyrrolopyrrole type compounds of the description given above, those which are desirable herein include 1,4-dithioketo-3,6-diphenylpyrrolo[3,4-c]pyrrole, 1,4-dithioketo-3,6-di(4-tolyl)pyrrolo[3,4-c]pyrrole, 1,4-dithioketo-3,6-di(4-ethylphenyl)pyrrolo[3,4-c]pyrrole, 1-4-dithioketo-3,6-di(4-propylphenyl)pyrrolo[3,4-c]pyrrole, 1,4-dithioketo-3,6-di(4-isopropylphenyl)pyrrolo[3,4-c]-pyrrole, 1,4-dithioketo-3,6-di(4-butylphenyl)pyrrolo[3,4-c]pyrrole, 1,4-dithioketo-3,6-di(4-isobutylphenyl)pyrrolo-[3,4-c]pyrrole, 1,4-dithioketo-3,6-di(4-tert-butylphenyl)pyrrolo[3,4-c]pyrrole, 1,4-dithioketo-3,6-di(4-pentylphenyl)pyrrolo[3,4-c]pyrrole, 1,4-dithioketo-3,6-di4-hexylphenyl)pyrrolo[3,4-c]pyrrole, 1,4-dithioketo-3,6-di(3,5-dimethylphenyl)pyrrolo[3,4-c]pyrrole, 1,4-dithioketo-3,6-di(3,4,5-trimethylphenyl)pyrrolo[3,4-c]pyrrole, 1,4-dithioketo-3,6-di(4-methoxyphenyl)pyrrolo-[3,4-c]pyrrole, 1,4-dithioketo-3,6-di(4-ethoxyphenyl)pyrrolo[3,4-c]pyrrole, 1,4-dithioketo-3,6-di(4-propoxyphenyl)pyrrolo[3,4-c]pyrrole, 1,4-dithioketo-3,6-di(4-isopropoxyphenyl)pyrrolo[3,4-c]pyrrole, 1,4-dithioketo-3,6-di(4-butoxyphenylpyrrolo[3,4-c]pyrrole, 1,4-dithioketo-3,6-di(4-isobutoxyphenyl)pyrrolo[3,4-c]pyrrole, 1,4-dithioketo-3,6-di(4-tert-butoxyphenyl)pyrrolo[3,4-c]pyrrole, 1,4-dithioketo-3,6-di(4-pentyloxyphenyl)pyrrolo[3,4-c]pyrrole, 1,4-dithioketo-3,6-di(4-hexyloxyphenyl)pyrrolo[3,4-c]pyrrole, 1,4-dithioketo-3,6-di(3,5-dimethoxyphenyl)-pyrrolo[3,4-c]pyrrole, 1,4-dithioketo-3,6-di(3,4,5-trimethoxyphenyl)pyrrolo[3,4-c]pyrrole, 1,4-dithioketo-3,6-dibenzylpyrrolo[3,4-c]pyrrole, 1,4-dithioketo-3,6-dinaphthylpyrrolo[3,4-c]pyrrole, 1,4-dithioketo-3,6-di(4-cyanophenyl)pyrrolo[3,4-c]pyrrole, 1,4-dithioketo-3,6-di(4-chlorophenyl)pyrrolo[3,4-c]pyrrole, 1,4-dithioketo-3,6-di(2-bromophenyl)pyrrolo[3,4-c]pyrrole, 1,4-dithioketo-3,6-di(4-trifluoromethylphenyl)pyrrolo[3,4-c]pyrrole, 1,4-dithioketo-3,6-di(4-dimethylaminophenyl)pyrrolo[3,4-c]pyrrole, 1,4-dithioketo-3,6-di(4-diethylaminophenyl)pyrrolo[3,4-c]pyrrole, N,N'-dimethyl-1,4-dithioketo-3,6-diphenylpyrrolo[3,4-c]pyrrole, N,N'-dimethyl-1,4-dithioketo-3,6-ditolylpyrrolo[3,4-c]pyrrole, N,N'-dimethyl-1,4-ditioketo-3,6-di(4-ethylphenyl)pyrrolo[3,4-c]pyrrole, N,N'-dimethyl-1,4-dithioketo-3,6-di(4-isopropylphenyl)pyrrolo[3,4-c]pyrrole, N,N'-dimethyl-1,4-dithioketo-3,6-di(4-tert-butylphenyl)pyrrolo[3,4-c]pyrrole, N,N'-dimethyl-1,4-dithioketo-3,6-di(3,4,5-trimethylphenyl)pyrrolo[3,4-c]pyrrole, N,N'-dimethyl-1,4-dithioketo-3,6-di(4-methoxyphenyl)pyrrolo[3,4-c]pyrrole, N,N'-dimethyl-1,4-dithioketo-3,6-di(4-ethoxyphenyl)pyrrolo[3,4-c]pyrrole, N,N'-dimethyl-1,4-dithioketo-3,6-di(4-isopropoxyphenyl)pyrrolo[3,4-c]-pyrrole, N,N'-dimethyl-1,4-dithioketo-3,6-di(4-tert-butoxyphenyl)pyrrolo[3,4-c]pyrrole, N,N'-dimethyl-1,4-dithioketo-3,6-di(3,4,5-trimethoxyphenyl)pyrrolo[3,4-c]-pyrrole, 1,4-dithioketo-3,6-di(3-pyrrolyl)pyrrolo[3,4-c]pyrrole, 1,4-dithioketo-3,6-di(4-oxazolyl)pyrrolo[3,4-c]pyrrole, 1,4-dithioketo-3,6-di(4-thiazol)pyrrolo[3,4-c]pyrrole, 1,4-dithioketo-3,6-diimidazolylpyrrolo[3,4-c]pyrrole, 1,4-dithioketo-3,6-di(2-imidazolyl)pyrrolo[3,4-c]pyrrole, 1,4-dithioketo-3,6-di(4-imiazolyl)pyrrolo[3,4-c]pyrrole, 1,4-dithioketo-3,6-di(4-pyridylpyrrolo[3,4-c]pyrrole, 1,4-dithioketo-3,6-di(2-pyrimidinyl)pyrrolo[3,4-c]pyrrole, 1,4-dithioketo-3,6-dipiperidinopyrolo[3,4-c]pyrrole, 1,4-dithioketo-3,6-di(4-piperidinyl)pyrrolo[3,4-c]pyrrole, 1,4-dithioketo-3,6-dimorpholinopyrrolo[3,4-c]pyrrole, 1,4-dithioketo-3,6-di(2-quinolyl)pyrrolo[3,4-c]pyrrole, 1,4-dithioketo-3,6-di(3-benzo[b]thiophenyl)pyrrolo[3,4-c]pyrrole, 1,4-dithioketo-3,6-di(2-quinolyl)pyrrolo[3,4-c]-pyrrole, N'-dimethyl-1,4-dithioketo-3,6-di(4-imidazolyl)pyrrolo[3,4-c]pyrrole, N,N'-dimethyl-1,4-dithioketo-3,6-dimorpholinopyrrolo[3,4-c]pyrrole, and N,N'-dimethyl-1,4-dithioketo-3,6-di(4-pyridyl)pyrrolo[3,4-c]pyrrole, for example.

The pyrrolopyrrole type compounds represented by the aforementioned general formula (1) are used either single or jointly in the form of a mixture of two or more members.

Optionally, the pyrrolopyrrole type compounds represented by the aforementioned general formula (1) may be used as combined with a varying electric charge generating material in a ratio incapable of impeding the photosensitive property, for example. As concrete examples of the electric charge generating material usable in this case, there may be cited selenium, seleniumtellurium, amorphous silicon, pyrylium salts, azo type compounds, adizo type compounds, phthalocyanine type compounds, anthanthrone type compounds, perylene type compounds, indigo type compounds, triphenylmethane type compounds, threne type compounds, toluidine type compounds, pyrazoline type compounds, and quinacridone type compounds. The electric charge generating materials mentioned above are used either single or jointly in the form of a mixture of two or more members.

As concrete examples of the lower alkyl group, the lower alkoxy group, and the halogen atom of the substituents $R^5$, $R^6$, $R^7$, $R^8$, $R^9$, and $R^{10}$ in the general formula (2) representing the benzidine derivative to be contained in the photosensitive layer, there may be cited those substituents cited above with respect to the substituents $R^1$ and $R^2$. In the substituents $R^5$, $R^6$, $R^7$, $R^8$, $R^9$, and $R^{10}$ mentioned above, hydrogen atom, alkyl groups of 1 to 4 carbon atoms, alkoxy groups of 1 to 4 carbon atoms, and halogen atoms are desirable.

The substituents $R^5$, $R^6$, $R^7$, $R^8$, $R^9$, and $R^{10}$ may be attached to suitable positions in a benzene ring or a biphenyl backbone.

In the benzidine derivatives represented by the aforementioned general formula (2), the compounds shown in the following table may be cited as desirable examples.

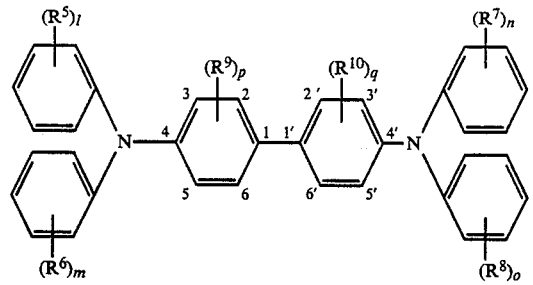

| Compound No. | $R^5$ | $R^6$ | $R^7$ | $R^8$ | $R^9$ | $R^{10}$ |
|---|---|---|---|---|---|---|
| 1 | H | H | H | H | H | H |
| 2 | 3-$CH_3$ | H | 3-$CH_3$ | H | H | H |
| 3 | 3-$CH_3$ | 3-$CH_3$ | 3-$CH_3$ | 3-$CH_3$ | H | H |
| 4 | 4-$CH_3$ | H | 4-$CH_3$ | H | H | H |
| 5 | 4-$CH_3$ | 4-$CH_3$ | 4-$CH_3$ | 4-$CH_3$ | H | H |
| 6 | 3,5-di $CH_3$ | H | 3,5-di $CH_3$ | H | H | H |
| 7 | 3,5-di $CH_3$ | 3,5-di $CH_3$ | 3,5-di $CH_3$ | 3,5-di $CH_3$ | H | H |
| 8 | 3-$CH_3$ | 3,5-di $CH_3$ | 3-$CH_3$ | 3,5-di $CH_3$ | H | H |
| 9 | 4-$CH_3$ | 3,5-di $CH_3$ | 4-$CH_3$ | 3,5-di $CH_3$ | H | H |
| 10 | 2,6-di $CH_3$ | H | 2,6-di $CH_3$ | H | H | H |
| 11 | 2,6-di $CH_3$ | 2,6-di $CH_3$ | 2,6-di $CH_3$ | 2,6-di $CH_3$ | H | H |
| 12 | 3-$CH_3$ | 2,6-di $CH_3$ | 3-$CH_3$ | 2,6-di $CH_3$ | H | H |
| 13 | 4-$CH_3$ | 2,6-di $CH_3$ | 4-$CH_3$ | 2,6-di $CH_3$ | H | H |
| 14 | 3,4,5-tri $CH_3$ | H | 3,4,5-tri $CH_3$ | H | H | H |
| 15 | 3,4,5-tri $CH_3$ | 3,4,5-tri $CH_3$ | 3,4,5-tri $CH_3$ | 3,4,5-tri $CH_3$ | H | H |
| 16 | 3-$CH_3$ | 3,4,5-tri $CH_3$ | 3-$CH_3$ | 3,4,5-tri $CH_3$ | H | H |
| 17 | 4-$CH_3$ | 3,4,5-tri $CH_3$ | 4-$CH_3$ | 3,4,5-tri $CH_3$ | H | H |
| 18 | 3,5-di $CH_3$ | 3,4,5-tri $CH_3$ | 3,5-di $CH_3$ | 3,4,5-tri $CH_3$ | H | H |
| 19 | H | H | H | H | 2-$CH_3$ | 2'-$CH_3$ |
| 20 | 3-$CH_3$ | H | 3-$CH_3$ | H | 2-$CH_3$ | 2'-$CH_3$ |
| 21 | 3-$CH_3$ | 3-$CH_3$ | 3-$CH_3$ | 3-$CH_3$ | 2-$CH_3$ | 2'-$CH_3$ |
| 22 | 4-$CH_3$ | H | 4-$CH_3$ | H | 2-$CH_3$ | 2'-$CH_3$ |
| 23 | 4-$CH_3$ | 4-$CH_3$ | 4-$CH_3$ | 4-$CH_3$ | 2-$CH_3$ | 2'-$CH_3$ |
| 24 | 3,5-di $CH_3$ | H | 3,5-di $CH_3$ | H | 2-$CH_3$ | 2'-$CH_3$ |
| 25 | 3,5-di $CH_3$ | 3,5-di $CH_3$ | 3,5-di $CH_3$ | 3,5-di $CH_3$ | 2-$CH_3$ | 2'-$CH_3$ |
| 26 | 3-$CH_3$ | 3,5-di $CH_3$ | 3-$CH_3$ | 3,5-di $CH_3$ | 2-$CH_3$ | 2'-$CH_3$ |
| 27 | 4-$CH_3$ | 3,5-di $CH_3$ | 4-$CH_3$ | 3,5-di $CH_3$ | 2-$CH_3$ | 2'-$CH_3$ |
| 28 | 2,6-di $CH_3$ | H | 2,6-di $CH_3$ | H | 2-$CH_3$ | 2'-$CH_3$ |
| 29 | 2,6-di $CH_3$ | 2,6-di $CH_3$ | 2,6-di $CH_3$ | 2,6-di $CH_3$ | 2-$CH_3$ | 2'-$CH_3$ |
| 30 | 3-$CH_3$ | 2,6-di $CH_3$ | 3-$CH_3$ | 2,6-di $CH_3$ | 2-$CH_3$ | 2'-$CH_3$ |
| 31 | 4-$CH_3$ | 2,6-di $CH_3$ | 4-$CH_3$ | 2,6-di $CH_3$ | 2-$CH_3$ | 2'-$CH_3$ |
| 32 | 3,4,5- | H tri $CH_3$ | 3,4,5- | H tri $CH_3$ | 2-$CH_3$ | 2'-$CH_3$ |
| 33 | 3,4,5-tri $CH_3$ | 3,4,5-tri $CH_3$ | 3,4,5-tri $CH_3$ | 3,4,5-tri $CH_3$ | 2-$CH_3$ | 2'-$CH_3$ |
| 34 | 3-$CH_3$ | 3,4,5-tri $CH_3$ | 3-$CH_3$ | 3,4,5-tri $CH_3$ | 2-$CH_3$ | 2'-$CH_3$ |
| 35 | 4-$CH_3$ | 3,4,5-tri $CH_3$ | 4-$CH_3$ | 3,4,5-tri $CH_3$ | 2-$CH_3$ | 2'-$CH_3$ |
| 36 | 3,5- | 3,4,5- | 3,5- | 3,4,5- | 2-$CH_3$ | 2'-$CH_3$ |

-continued

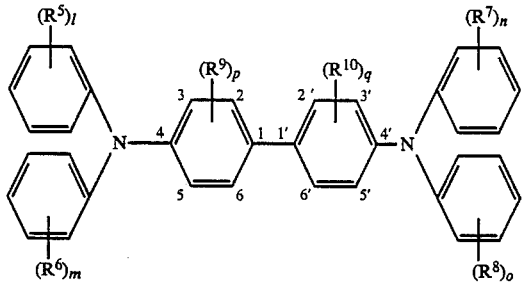

| Compound No. | $R^5$ | $R^6$ | $R^7$ | $R^8$ | $R^9$ | $R^{10}$ |
|---|---|---|---|---|---|---|
| | di $CH_3$ | tri $CH_3$ | di $CH_3$ | tri $CH_3$ | | |
| 37 | H | H | H | H | 3-$CH_3$ | 3'-$CH_3$ |
| 38 | 3-$CH_3$ | H | 3-$CH_3$ | H | 3-$CH_3$ | 3'-$CH_3$ |
| 39 | 3-$CH_3$ | 3-$CH_3$ | 3-$CH_3$ | 3-$CH_3$ | 3-$CH_3$ | 3'-$CH_3$ |
| 40 | 4-$CH_3$ | H | 4-$CH_3$ | H | 3-$CH_3$ | 3'-$CH_3$ |
| 41 | 4-$CH_3$ | 4-$CH_3$ | 4-$CH_3$ | 4-$CH_3$ | 3-$CH_3$ | 3'-$CH_3$ |
| 42 | 3,5-di $CH_3$ | H | 3,5-di $CH_3$ | H | 3-$CH_3$ | 3'-$CH_3$ |
| 43 | 3,5-di $CH_3$ | 3,5-di $CH_3$ | 3,5-di $CH_3$ | 3,5-di $CH_3$ | 3-$CH_3$ | 3'-$CH_3$ |
| 44 | 3-$CH_3$ | 3,5-di $CH_3$ | 3-$CH_3$ | 3,5-di $CH_3$ | 3-$CH_3$ | 3'-$CH_3$ |
| 45 | 4-$CH_3$ | 3,5-di $CH_3$ | 4-$CH_3$ | 3,5-di $CH_3$ | 3-$CH_3$ | 3'-$CH_3$ |
| 46 | 2,6-di $CH_3$ | H | 2,6-di $CH_3$ | H | 3-$CH_3$ | 3'-$CH_3$ |
| 47 | 2,6-di $CH_3$ | 2,6-di $CH_3$ | 2,6-di $CH_3$ | 2,6-di $CH_3$ | 3-$CH_3$ | 3'-$CH_3$ |
| 48 | 3-$CH_3$ | 2,6-di $CH_3$ | 3-$CH_3$ di $CH_3$ | 2,6- | 3-$CH_3$ | 3'-$CH_3$ |
| 49 | 4-$CH_3$ | 2,6-di $CH_3$ | 4-$CH_3$ | 2,6-di $CH_3$ | 3-$CH_3$ | 3'-$CH_3$ |
| 50 | 3,4,5-tri $CH_3$ | H | 3,4,5-tri $CH_3$ | H | 3-$CH_3$ | 3'-$CH_3$ |
| 51 | 3,4,5-tri $CH_3$ | 3,4,5-tri $CH_3$ | 3,4,5-tri $CH_3$ | 3,4,5-tri $CH_3$ | 3-$CH_3$ | 3'-$CH_3$ |
| 52 | 3-$CH_3$ | 3,4,5-tri $CH_3$ | 3-$CH_3$ | 3,4,5-tri $CH_3$ | 3-$CH_3$ | 3'-$CH_3$ |
| 53 | 4-$CH_3$ | 3,4,5-tri $CH_3$ | 4-$CH_3$ | 3,4,5-tri $CH_3$ | 3-$CH_3$ | 3'-$CH_3$ |
| 54 | 3,5-di $CH_3$ | 3,4,5-tri $CH_3$ | 3,5-di $CH_3$ | 3,4,5-tri $CH_3$ | 3-$CH_3$ | 3'-$CH_3$ |
| 55 | H | H | H | H | 2,5-di $CH_3$ | 2',5'-di $CH_3$ |
| 56 | 3-$CH_3$ | H | 3-$CH_3$ | H | 2,5-di $CH_3$ | 2',5'-di $CH_3$ |
| 57 | 3-$CH_3$ | 3-$CH_3$ | 3-$CH_3$ | 3-$CH_3$ | 2,5-di $CH_3$ | 2',5'-di $CH_3$ |
| 58 | 4-$CH_3$ | H | 4-$CH_3$ | H | 2,5-di $CH_3$ | 2',5'-di $CH_3$ |
| 59 | 4-$CH_3$ | 4-$CH_3$ | 4-$CH_3$ | 4-$CH_3$ | 2,5,-di $CH_3$ | 2',5'-di $CH_3$ |
| 60 | 3,5-di $CH_3$ | H | 3,5-di $CH_3$ | H | 2,5,-di $CH_3$ | 2',5'-di $CH_3$ |
| 61 | 3,5-di $CH_3$ | 3,5-di $CH_3$ | 3,5-di $CH_3$ | 3,5-di $CH_3$ | 2,5,-di $CH_3$ | 2',5'-di $CH_3$ |
| 62 | 3-$CH_3$ | 3,5-di $CH_3$ | 3-$CH_3$ | 3,5-di $CH_3$ | 2,5-di $CH_3$ | 2',5'-di $CH_3$ |
| 63 | 4-$CH_3$ | 3,5-di $CH_3$ | 4-$CH_3$ | 3,5-di $CH_3$ | 2,5,-di $CH_3$ | 2',5'-di $CH_3$ |
| 64 | 2,6-di $CH_3$ | H | 2,6-di $CH_3$ | H | 2,5-di $CH_3$ | 2',5'-di $CH_3$ |
| 65 | 2,6-di $CH_3$ | 2,6-di $CH_3$ | 2,6-di $CH_3$ | 2,6-di $CH_3$ | 2,5-di $CH_3$ | 2',5'-di $CH_3$ |
| 66 | 3-$CH_3$ | 2,6-di $CH_3$ | 3-$CH_3$ | 2,6-di $CH_3$ | 2,5-di $CH_3$ | 2',5'-di $CH_3$ |
| 67 | 4-$CH_3$ | 2,6-di $CH_3$ | 4-$CH_3$ | 2,6-di $CH_3$ | 2,5-di $CH_3$ | 2',5'-di $CH_3$ |
| 68 | 3,4,5-tri $CH_3$ | H | 3,4,5-tri $CH_3$ | H | 2,5-di $CH_3$ | 2',5'-di $CH_3$ |
| 69 | 3,4,5-tri $CH_3$ | 3,4,5-tri $CH_3$ | 3,4,5-tri $CH_3$ | 3,4,5-tri $CH_3$ | 2,5-di $CH_3$ | 2',5'-di $CH_3$ |
| 70 | 3-$CH_3$ | 3,4,5-tri $CH_3$ | 3-$CH_3$ | 3,4,5-tri $CH_3$ | 2,5-di $CH_3$ | 2',5'-di $CH_3$ |
| 71 | 4-$CH_3$ | 3,4,5-tri $CH_3$ | 4-$CH_3$ | 3,4,5-tri $CH_3$ | 2,5-di $CH_3$ | 2',5'-di $CH_3$ |

-continued

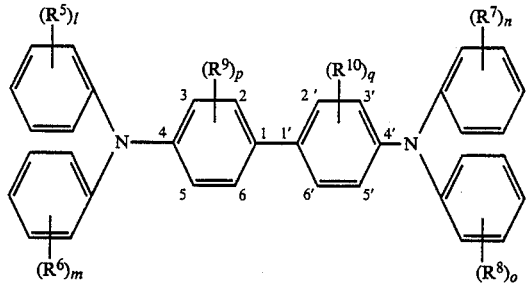

| Compound No. | $R^5$ | $R^6$ | $R^7$ | $R^8$ | $R^9$ | $R^{10}$ |
|---|---|---|---|---|---|---|
| 72 | 3,5-di $CH_3$ | 3,4,5-tri $CH_3$ | 3,5-di $CH_3$ | 3,4,5-tri $CH_3$ | 2,5-di $CH_3$ | 2',5'-di $CH_3$ |
| 73 | 4-$CH_3$ | H | 4-$CH_3$ | H | 3,5-di $CH_3$ | 3'-5'-di $CH_3$ |
| 74 | 4-$CH_3$ | 4-$CH_3$ | 4-$CH_3$ | 4-$CH_3$ | 3,5-di $CH_3$ | 3'-5'-di $CH_3$ |
| 75 | 3,5-di $CH_3$ | H | 3,5-di $CH_3$ | H | 3,5-di $CH_3$ | 3'-5'-di $CH_3$ |
| 76 | 3,5-di $CH_3$ | 3,5-di $CH_3$ | 3,5-di $CH_3$ | 3,5-di $CH_3$ | 3,5-di $CH_3$ | 3'-5'-di $CH_3$ |
| 77 | 3,4,5-tri $CH_3$ | H | 3,4,5-tri $CH_3$ | H | 3,5-di $CH_3$ | 3'-5'-di $CH_3$ |
| 78 | 3,4,5-tri $CH_3$ | 3,4,5-tri $CH_3$ | 3,4,5-tri $CH_3$ | 3,4,5-tri $CH_3$ | 3,5-di $CH_3$ | 3'-5'-di $CH_3$ |
| 79 | 3-$OCH_3$ | H | 3-$OCH_3$ | H | H | H |
| 80 | 3-$OCH_3$ | 3-$OCH_3$ | 3-$OCH_3$ | 3-$OCH_3$ | H | H |
| 81 | 4-$OCH_3$ | H | 4-$OCH_3$ | H | H | H |
| 82 | 4-$OCH_3$ | 4-$OCH_3$ | 4-$OCH_3$ | 4-$OCH_3$ | H | H |
| 83 | 3,5-di $OCH_3$ | H | 3,5-di $OCH_3$ | H | H | H |
| 84 | 3,5-di $OCH_3$ | 3,5-di $OCH_3$ | 3,5-di $OCH_3$ | 3,5-di $OCH_3$ | H | H |
| 85 | 3-$OCH_3$ | 3,5-di $OCH_3$ | 3-$OCH_3$ | 3,5-di $OCH_3$ | H | H |
| 86 | 4-$OCH_3$ | 3,5-di $OCH_3$ | 4-$OCH_3$ | 3,5-di $OCH_3$ | H | H |
| 87 | 2,6-di $OCH_3$ | H | 2,6-di $OCH_3$ | H | H | H |
| 88 | 2,6-di $OCH_3$ | 2,6-di $OCH_3$ | 2,6-di $OCH_3$ | 2,6-di $OCH_3$ | H | H |
| 89 | 3-$OCH_3$ | 2,6-di $OCH_3$ | 3-$OCH_3$ | 2,6-di $OCH_3$ | H | H |
| 90 | 4-$OCH_3$ | 2,6-di $OCH_3$ | 4-$OCH_3$ | 2,6-di $OCH_3$ | H | H |
| 91 | 3,4,5-tri $OCH_3$ | H | 3,4,5-tri $OCH_3$ | H | H | H |
| 92 | 3,4,5-tri $OCH_3$ | 3,4,5-tri $OCH_3$ | 3,4,5-tri $OCH_3$ | 3,4,5-tri $OCH_3$ | H | H |
| 93 | 3-$OCH_3$ | 3,4,5-tri $OCH_3$ | 3-$OCH_3$ | 3,4,5-tri $OCH_3$ | H | H |
| 94 | 4-$OCH_3$ | 3,4,5-tri $OCH_3$ | 4-$OCH_3$ | 3,4,5-tri $OCH_3$ | H | H |
| 95 | 3,5-di $OCH_3$ | 3,4,5-tri $OCH_3$ | 3,5-tri $OCH_3$ | 3,4,5-tri $OCH_3$ | H | H |
| 96 | H | H | H | H | 2-$OCH_3$ | 2'-$OCH_3$ |
| 97 | 3-$OCH_3$ | H | 3-$OCH_3$ | H | 2-$OCH_3$ | 2'-$OCH_3$ |
| 98 | 3-$OCH_3$ | 3-$OCH_3$ | 3-$OCH_3$ | 3-$OCH_3$ | 2-$OCH_3$ | 2'-$OCH_3$ |
| 99 | 4-$OCH_3$ | H | 4-$OCH_3$ | H | 2-$OCH_3$ | 2'-$OCH_3$ |
| 100 | 4-$OCH_3$ | 4-$OCH_3$ | 4-$OCH_3$ | 4-$OCH_3$ | 2-$OCH_3$ | 2'-$OCH_3$ |
| 101 | 3,5-di $OCH_3$ | H | 3,5-di $OCH_3$ | H | 2-$OCH_3$ | 2'-$OCH_3$ |
| 102 | 3,5-di $OCH_3$ | 3,5-di $OCH_3$ | 3,5-di $OCH_3$ | 3,5-di $OCH_3$ | 2-$OCH_3$ | 2'-$OCH_3$ |
| 103 | 3-$OCH_3$ | 3,5-di $OCH_3$ | 3-$OCH_3$ | 3,5-di $OCH_3$ | 2-$OCH_3$ | 2'-$OCH_3$ |
| 104 | 4-$OCH_3$ | 3,5-di $OCH_3$ | 4-$OCH_3$ | 3,5-di $OCH_3$ | 2-$OCH_3$ | 2'-$OCH_3$ |
| 105 | 2,6-di $OCH_3$ | H | 2,6-di $OCH_3$ | H | 2-$OCH_3$ | 2'-$OCH_3$ |
| 106 | 2,6-di $OCH_3$ | 2,6-di $OCH_3$ | 2,6-di $OCH_3$ | 2,6-di $OCH_3$ | 2-$OCH_3$ | 2'-$OCH_3$ |
| 107 | 3-$OCH_3$ | 2,6-di $OCH_3$ | 3-$OCH_3$ | 2,6-di $OCH_3$ | 2-$OCH_3$ | 2'-$OCH_3$ |
| 108 | 4-$OCH_3$ | 2,6-di $OCH_3$ | 4-$OCH_3$ | 2,6-di $OCH_3$ | 2-$OCH_3$ | 2'-$OCH_3$ |
| 109 | 3,4,5- | H | 3,4,5- | H | 2-$OCH_3$ | 2'-$OCH_3$ |

-continued

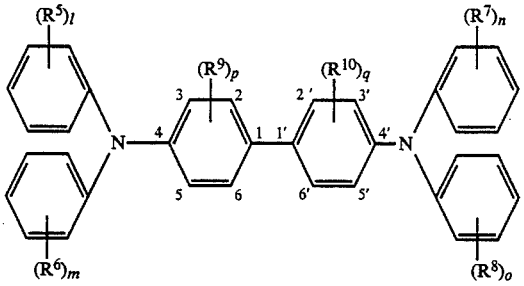

| Compound No. | $R^5$ | $R^6$ | $R^7$ | $R^8$ | $R^9$ | $R^{10}$ |
|---|---|---|---|---|---|---|
| | tri $OCH_3$ | | tri $OCH_3$ | | | |
| 110 | 3,4,5-tri $OCH_3$ | 3,4,5-tri $OCH_3$ | 3,4,5-tri $OCH_3$ | 3,4,5-tri $OCH_3$ | 2-$OCH_3$ | 2'-$OCH_3$ |
| 111 | 3-$OCH_3$ | 3,4,5-tri $OCH_3$ | 3-$OCH_3$ | 3,4,5-tri $OCH_3$ | 2-$OCH_3$ | 2'-$OCH_3$ |
| 112 | 4-$OCH_3$ | 3,4,5-tri $OCH_3$ | 4-$OCH_3$ | 3,4,5-tri $OCH_3$ | 2-$OCH_3$ | 2'-$OCH_3$ |
| 113 | 3,5-di $OCH_3$ | 3,4,5-tri $OCH_3$ | 3,5-di $OCH_3$ | 3,4,5-tri $OCH_3$ | 2-$OCH_3$ | 2'-$OCH_3$ |
| 114 | H | H | H | H | 3-$OCH_3$ | 3'-$OCH_3$ |
| 115 | 3-$OCH_3$ | H | 3-$OCH_3$ | H | 3-$OCH_3$ | 3'-$OCH_3$ |
| 116 | 3-$OCH_3$ | 3-$OCH_3$ | 3-$OCH_3$ | 3-$OCH_3$ | 3-$OCH_3$ | 3'-$OCH_3$ |
| 117 | 4-$OCH_3$ | H | 4-$OCH_3$ | H | 3-$OCH_3$ | 3'-$OCH_3$ |
| 118 | 4-$OCH_3$ | 4-$OCH_3$ | 4-$OCH_3$ | 4-$OCH_3$ | 3-$OCH_3$ | 3'-$OCH_3$ |
| 119 | 3,5-di $OCH_3$ | H | 3,5-di $OCH_3$ | H | 3-$OCH_3$ | 3'-$OCH_3$ |
| 120 | 3,5-di $OCH_3$ | 3,5-di $OCH_3$ | 3,5-di $OCH_3$ | 3,5-di $OCH_3$ | 3-$OCH_3$ | 3'-$OCH_3$ |
| 121 | 3-$OCH_3$ | 3,5-di $OCH_3$ | 3-$OCH_3$ | 3,5-di $OCH_3$ | 3-$OCH_3$ | 3'-$OCH_3$ |
| 122 | 4-$OCH_3$ | 3,5-di $OCH_3$ | 4-$OCH_3$ | 3,5-di $OCH_3$ | 3-$OCH_3$ | 3'-$OCH_3$ |
| 123 | 2,6-di $OCH_3$ | H | 2,6-di $OCH_3$ | H | 3-$OCH_3$ | 3'-$OCH_3$ |
| 124 | 2,6-di $OCH_3$ | 2,6-di $OCH_3$ | 2,6-di $OCH_3$ | 2,6-di $OCH_3$ | 3-$OCH_3$ | 3'-$OCH_3$ |
| 125 | 3-$OCH_3$ | 2,6-di $OCH_3$ | 3-$OCH_3$ | 2,6-di $OCH_3$ | 3-$OCH_3$ | 3'-$OCH_3$ |
| 126 | 4-$OCH_3$ | 2,6-di $OCH_3$ | 4-$OCH_3$ | 2,6-di $OCH_3$ | 3-$OCH_3$ | 3'-$OCH_3$ |
| 127 | 3,4,5-tri $OCH_3$ | H | 3,4,5-tri $OCH_3$ | H | 3-$OCH_3$ | 3'-$OCH_3$ |
| 128 | 3,4,5-tri $OCH_3$ | 3,4,5-tri $OCH_3$ | 3,4,5-tri $OCH_3$ | 3,4,5-tri $OCH_3$ | 3-$OCH_3$ | 3-$OCH_3$ |
| 129 | 3-$OCH_3$ | 3,4,5-tri $OCH_3$ | 3-$OCH_3$ | 3,4,5-tri $OCH_3$ | 3-$OCH_3$ | 3'-$OCH_3$ |
| 130 | 4-$OCH_3$ | 3,4,5-tri $OCH_3$ | 4-$OCH_3$ | 3,4,5-tri $OCH_3$ | 3-$OCH_3$ | 3'-$OCH_3$ |
| 131 | 3,5-tri $OCH_3$ | 3,4,5-tri $OCH_3$ | 3,5-tri $OCH_3$ | 3,4,5-tri $OCH_3$ | 3-$OCH_3$ | 3'-$OCH_3$ |
| 132 | H | H | H | H | 2,5-di $OCH_3$ | 2',5'-di $OCH_3$ |
| 133 | 3-$OCH_3$ | H | 3-$OCH_3$ | H | 2,5-di $OCH_3$ | 2',5'-di $OCH_3$ |
| 134 | 3-$OCH_3$ | 3-$OCH_3$ | 3-$OCH_3$ | 3-$OCH_3$ | 2,5,-di $OCH_3$ | 2',5'-di $OCH_3$ |
| 135 | 4-$OCH_3$ | H | 4-$OCH_3$ | H | 2,5,-di $OCH_3$ | 2',5'-di $OCH_3$ |
| 136 | 4-$OCH_3$ | 4-$OCH_3$ | 4-$OCH_3$ | 4-$OCH_3$ | 2,5,-di $OCH_3$ | 2',5'-di $OCH_3$ |
| 137 | 3,5-di $OCH_3$ | H | 3,5-di $OCH_3$ | H | 2,5,-di $OCH_3$ | 2',5'-di $OCH_3$ |
| 138 | 3,5-di $OCH_3$ | 3,5-di $OCH_3$ | 3,5-di $OCH_3$ | 3,5-di $OCH_3$ | 2,5-di $OCH_3$ | 2',5'-di $OCH_3$ |
| 139 | 3-$OCH_3$ | 3,5-di $OCH_3$ | 3-$OCH_3$ | 3,5-di $OCH_3$ | 2,5,-di $OCH_3$ | 2',5'-di $OCH_3$ |
| 140 | 4-$OCH_3$ | 3,5-di $OCH_3$ | 4-$OCH_3$ | 3,5-di $OCH_3$ | 2,5,-di $OCH_3$ | 2',5'-di $OCH_3$ |
| 141 | 2,6-di $OCH_3$ | H | 2,6-di $OCH_3$ | H | 2,5-di $OCH_3$ | 2',5'-di $OCH_3$ |
| 142 | 2,6-di $OCH_3$ | 2,6-di $OCH_3$ | 2,6-di $OCH_3$ | 2,6-di $OCH_3$ | 2,5-di $OCH_3$ | 2',5'-di $OCH_3$ |
| 143 | 3-$OCH_3$ | 2,6-di $OCH_3$ | 3-$OCH_3$ | 2,6-di $OCH_3$ | 2,5-di $OCH_3$ | 2',5'-di $OCH_3$ |
| 144 | 4-$OCH_3$ | 2,6-di $OCH_3$ | 4-$OCH_3$ | 2,6-di $OCH_3$ | 2,5-di $OCH_3$ | 2',5'-di $OCH_3$ |

-continued

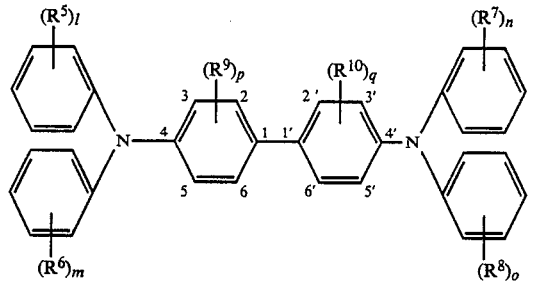

| Compound No. | $R^5$ | $R^6$ | $R^7$ | $R^8$ | $R^9$ | $R^{10}$ |
|---|---|---|---|---|---|---|
| 145 | 3,4,5-tri $OCH_3$ | H | 3,4,5-tri $OCH_3$ | H | 2,5-di $OCH_3$ | 2',5'-di $OCH_3$ |
| 146 | 3,4,5-tri $OCH_3$ | 3,4,5-tri $OCH_3$ | 3,4,5-tri $OCH_3$ | 3,4,5-tri $OCH_3$ | 2,5-di $OCH_3$ | 2',5'-di $OCH_3$ |
| 147 | 3-$OCH_3$ | 3,4,5-tri $OCH_3$ | 3-$OCH_3$ | 3,4,5-tri $OCH_3$ | 2,5-di $OCH_3$ | 2',5'-di $OCH_3$ |
| 148 | 4-$OCH_3$ | 3,4,5-tri $OCH_3$ | 4-$OCH_3$ | 3,4,5-tri $OCH_3$ | 2,5-di $OCH_3$ | 2',5'-di $OCH_3$ |
| 149 | 3,5-di $OCH_3$ | 3,4,5-tri $OCH_3$ | 3,5-di $OCH_3$ | 3,4,5-tri $OCH_3$ | 2,5-di $OCH_3$ | 2',5'-di $OCH_3$ |
| 150 | 4-$OCH_3$ | H | 4-$OCH_3$ | H | 3,5-di $OCH_3$ | 3'-5'-di $OCH_3$ |
| 151 | 4-$OCH_3$ | 4-$OCH_3$ | 4-$OCH_3$ | 4-$OCH_3$ | 3,5-di $OCH_3$ | 3'-5'-di $OCH_3$ |
| 152 | 3,5-di $OCH_3$ | H | 3,5-di $OCH_3$ | H | 3,5-di $OCH_3$ | 3'-5'-di $OCH_3$ |
| 153 | 3,5-di $OCH_3$ | 3,5-di $OCH_3$ | 3,5-di $OCH_3$ | 3,5-di $OCH_3$ | 3,5-di $OCH_3$ | 3'-5'-di $OCH_3$ |
| 154 | 3,4,5-tri $OCH_3$ | H | 3,4,5-tri $OCH_3$ | H | 3,5-di $OCH_3$ | 3',5'-di $OCH_3$ |
| 155 | 3,4,5-tri $OCH_3$ | 3,4,5-tri $OCH_3$ | 3,4,5-tri $OCH_3$ | 3,4,5-tri $OCH_3$ | 3,5-di $OCH_3$ | 3',5'-di $OCH_3$ |
| 156 | 3-Cl | H | 3-Cl | H | H | H |
| 157 | 3-Cl | 3-Cl | 3-Cl | 3-Cl | H | H |
| 158 | 4-Cl | H | 4-Cl | H | H | H |
| 159 | 4-Cl | 4-Cl | 4-Cl | 4-Cl | H | H |
| 160 | 3,5-di Cl | H | 3,5-di Cl | H | H | H |
| 161 | 3,5-di Cl | 3,5-di Cl | 3,5-di Cl | 3,5-di Cl | H | H |
| 162 | 3-Cl | 3,5-di Cl | 3-Cl | 3,5-di Cl | H | H |
| 163 | 4-Cl | 3,5-di Cl | 4-Cl | 3,5-di Cl | H | H |
| 164 | 2,6-di Cl | H | 2,6-di Cl | H | H | H |
| 165 | 2,6-di Cl | 2,6-di Cl | 2,6-di Cl | 2,6-di Cl | H | H |
| 166 | 3-Cl | 2,6-di Cl | 3-Cl | 2,6-di Cl | H | H |
| 167 | 4-Cl | 2,6-di Cl | 4-Cl | 2,6-di Cl | H | H |
| 168 | 3,4,5-tri Cl | H | 3,4,5-tri Cl | H | H | H |
| 169 | 3,4,5-tri Cl | 3,4,5-tri Cl | 3,4,5-tri Cl | 3,4,5-tri Cl | H | H |
| 170 | 3-Cl | 3,4,5-tri Cl | 3-Cl | 3,4,5-tri Cl | H | H |
| 171 | 4-Cl | 3,4,5-tri Cl | 4-Cl | 3,4,5-tri Cl | H | H |
| 172 | 3,5-di Cl | 3,4,5-tri Cl | 3,5-di Cl | 3,4,5-tri Cl | H | H |
| 173 | H | H | H | H | 2-Cl | 2'-Cl |
| 174 | 3-Cl | H | 3-Cl | H | 2-Cl | 2'-Cl |
| 175 | 3-Cl | 3-Cl | 3-Cl | 3-Cl | 2-Cl | 2'-Cl |
| 176 | 4-Cl | H | 4-Cl | H | 2-Cl | 2'-Cl |
| 177 | 4-Cl | 4-Cl | 4-Cl | 4-Cl | 2-Cl | 2'-Cl |
| 178 | 3,5-di Cl | H | 3,5-di Cl | H | 2-Cl | 2'-Cl |
| 179 | 3,5-di Cl | 3,5-di Cl | 3,5-di Cl | 3,5-di Cl | 2-Cl | 2'-Cl |
| 180 | 3-Cl | 3,5-di Cl | 3-Cl | 3,5-di Cl | 2-Cl | 2'-Cl |
| 181 | 4-Cl | 3,5-di Cl | 4-Cl | 3,5-di Cl | 2-Cl | 2'-Cl |
| 182 | 2,6- | H | 2,6- | H | 2-Cl | 2'-Cl |

-continued

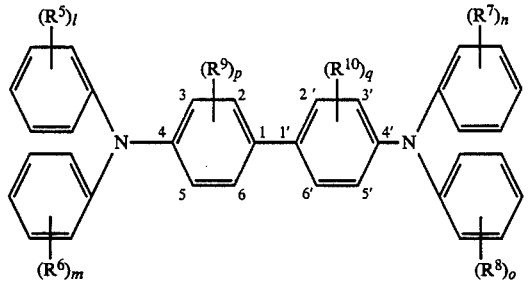

| Compound No. | $R^5$ | $R^6$ | $R^7$ | $R^8$ | $R^9$ | $R^{10}$ |
|---|---|---|---|---|---|---|
| | di Cl | | di Cl | | | |
| 183 | 2,6-di Cl | 2,6-di Cl | 2,6-di Cl | 2,6-di Cl | 2-Cl | 2'-Cl |
| 184 | 3-Cl | 2,6-di Cl | 3-Cl | 2,6-di Cl | 2-Cl | 2'-Cl |
| 185 | 4-Cl | 2,6-di Cl | 4-Cl | 2,6-di Cl | 2-Cl | 2'-Cl |
| 186 | 3,4,5-tri Cl | H | 3,4,5-tri Cl | H | 2-Cl | 2'-Cl |
| 187 | 3,4,5-tri Cl | 3,4,5-tri Cl | 3,4,5-tri Cl | 3,4,5-tri Cl | 2-Cl | 2'-Cl |
| 188 | 3-Cl | 3,4,5-tri Cl | 3-Cl | 3,4,5-tri Cl | 2-Cl | 2'-Cl |
| 189 | 4-Cl | 3,4,5-tri Cl | 4-Cl | 3,4,5-tri Cl | 2-Cl | 2'-Cl |
| 190 | 3,5-di Cl | 3,4,5-tri Cl | 3,5-di Cl | 3,4,5-tri Cl | 2-Cl | 2'-Cl |
| 191 | H | H | H | H | 3-Cl | 3'-Cl |
| 192 | 3-Cl | H | 3-Cl | H | 3-Cl | 3'-Cl |
| 193 | 3-Cl | 3-Cl | 3-Cl | 3-Cl | 3-Cl | 3'-Cl |
| 194 | 4-Cl | H | 4-Cl | H | 3-Cl | 3'-Cl |
| 195 | 4-Cl | 4-Cl | 4-Cl | 4-Cl | 3-Cl | 3'-Cl |
| 196 | 3,5-di Cl | H | 3,5-di Cl | H | 3-Cl | 3'-Cl |
| 197 | 3,5-di Cl | 3,5-di Cl | 3,5-di Cl | 3,5-di Cl | 3-Cl | 3'-Cl |
| 198 | 3-Cl | 3,5-di Cl | 3-Cl | 3,5-di Cl | 3-Cl | 3'-Cl |
| 199 | 4-Cl | 3,5-di Cl | 4-Cl | 3,5-di Cl | 3-Cl | 3'-Cl |
| 200 | 2,6-di Cl | H | 2,6-di Cl | H | 3-Cl | 3'-Cl |
| 201 | 2,6-di Cl | 2,6-di Cl | 2,6-di Cl | 2,6-di Cl | 3-Cl | 3'-Cl |
| 202 | 3-Cl | 2,6-di Cl | 3-Cl | 2,6-di Cl | 3-Cl | 3'-Cl |
| 203 | 4-Cl | 2,6-di Cl | 4-Cl | 2,6-di Cl | 3-Cl | 3'-Cl |
| 204 | 3,4,5-tri Cl | H | 3,4,5-tri Cl | H | 3-Cl | 3'-Cl |
| 205 | 3,4,5-tri Cl | 3,4,5-tri Cl | 3,4,5-tri Cl | 3,4,5-tri Cl | 3-Cl | 3'-Cl |
| 206 | 3-Cl | 3,4,5-tri Cl | 3-Cl | 3,4,5-tri Cl | 3-Cl | 3'-Cl |
| 207 | 4-Cl | 3,4,5-tri Cl | 4-Cl | 3,4,5-tri Cl | 3-Cl | 3'-Cl |
| 208 | 3,5-di Cl | 3,4,5-tri Cl | 3,5-di Cl | 3,4,5-tri Cl | 3-Cl | 3'-Cl |
| 209 | H | H | H | H | 2,5-di Cl | 2',5'-di Cl |
| 210 | 3-Cl | H | 3-Cl | H | 2,5-di Cl | 2',5'-di Cl |
| 211 | 3-Cl | 3-Cl | 3-Cl | 3-Cl | 2,5-di Cl | 2',5'-di Cl |
| 212 | 4-Cl | H | 4-Cl | H | 2,5-di Cl | 2',5'-di Cl |
| 213 | 4-Cl | 4-Cl | 4-Cl | 4-Cl | 2,5-di Cl | 2',5'-di Cl |
| 214 | 3,5-di Cl | H | 3,5-di Cl | H | 2,5-di Cl | 2',5'-di Cl |
| 215 | 3,5-di Cl | 3,5-di Cl | 3,5-di Cl | 3,5-di Cl | 2,5-di Cl | 2',5'-di Cl |
| 216 | 3-Cl | 3,5-di Cl | 3-Cl | 3,5-di Cl | 2,5-di Cl | 2',5'-di Cl |
| 217 | 4-Cl | 3,5-di Cl | 4-Cl | 3,5-di Cl | 2,5-di Cl | 2',5'-di Cl |

-continued

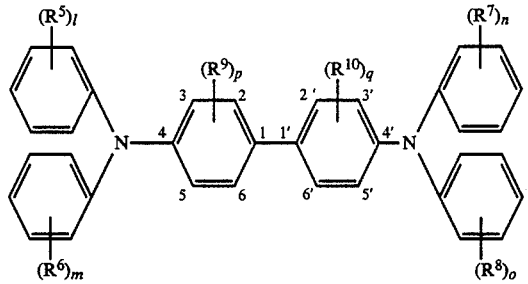

| Compound No. | $R^5$ | $R^6$ | $R^7$ | $R^8$ | $R^9$ | $R^{10}$ |
|---|---|---|---|---|---|---|
| 218 | 2,6-di Cl | H | 2,6-di Cl | H | 2,5-di Cl | 2',5'-di Cl |
| 219 | 2,6-di Cl | 2,6-di Cl | 2,6-di Cl | 2,6-di Cl | 2,5-di Cl | 2',5'-di Cl |
| 220 | 3-Cl | 2,6-di Cl | 3-Cl | 2,6-di Cl | 2,5-di Cl | 2',5'-di Cl |
| 221 | 4-Cl | 2,6-di Cl | 4-Cl | 2,6-di Cl | 2,5-di Cl | 2',5'-di Cl |
| 222 | 3,4,5-tri Cl | H | 3,4,5-tri Cl | H | 2,5-di Cl | 2',5'-di Cl |
| 223 | 3,4,5-tri Cl | 3,4,5-tri Cl | 3,4,5-tri Cl | 3,4,5-tri Cl | 2,5-di Cl | 2',5'-di Cl |
| 224 | 3-Cl. | 3,4,5-tri Cl | 3-Cl | 3,4,5-tri Cl | 2,5-di Cl | 2',5'-di Cl |
| 225 | 4-Cl | 3,4,5-tri Cl | 4-Cl | 3,4,5-tri Cl | 2,5-di Cl | 2',5'-di Cl |
| 226 | 3,5-di Cl | 3,4,5-tri Cl | 3,5-di Cl | 3,4,5-tri Cl | 2,5-di Cl | 2',5'-di Cl |
| 227 | 4-Cl | H | 4-Cl | H | 3,5-di Cl | 3',5'-di Cl |
| 228 | 4-Cl | 4-Cl | 4-Cl | 4-Cl | 3,5-di Cl | 3',5'-di Cl |
| 229 | 3,5-di Cl | H | 3,5-di Cl | H | 3,5-di Cl | 3',5'-di Cl |
| 230 | 3,5-di Cl | 3,5-di Cl | 3,5-di Cl | 3,5-di Cl | 3,5-di Cl | 3',5'-di Cl |
| 231 | 3,4,5-tri Cl | H | 3,4,5-tri Cl | H | 3,5-di Cl | 3',5'-di Cl |
| 232 | 3,4,5-tri Cl | 3,4,5-tri Cl | 3,4,5-tri Cl | 3,4,5-tri Cl | 3,5-di Cl | 3',5'-di Cl |
| 233 | H | 2,4-di $CH_3$ | H | 2,4-di $CH_3$ | H | H |

The benzidine derivatives represented by the aforementioned general formula (2) are used either singly or jointly in the form of a mixture of two or more members. The benzidine derivatives represented by the aforementioned general formula (2) are excellent in stability to resist light and do not yield to such reactions as isomerization on exposure to light. The benzidine derivatives possess high degrees of drift mobility and have small dependency for drift mobility upon the intensity of an electric field.

The sensitive material of high sensitivity and low residual potential is obtained by producing a photosensitive layer using a benzidine derivative represented by the aforementioned general formula (2) in combination with a pyrrolopyrrole type compound represented by the aforementioned general formula (1). This sensitive material produces images of high quality free from fogging.

The compounds represented by the aforementioned general formula (2) can be produced by using any of various methods. They may be produced, for example, by causing a compound represented by the following general formula (3) to react with compounds represented by the following general formulas (4) to (7) simultaneously or sequentially.

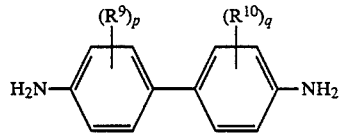

(3)

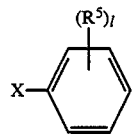

(4)

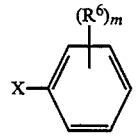

(5)

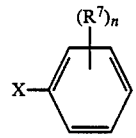

(6)

-continued

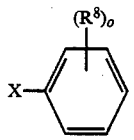

(7)

(wherein $R^5$, $R^6$, $R^7$, $R^8$, $R^9$, $R^{10}$, l, m, n, o, p, and q have the same meanings as defined above and X stands for a halogen atoms such as iodine).

The reaction of the compound represented by the aforementioned general formula (3) with the compounds represented by the aforementioned general formulas (4) to (7) is generally carried out in an organic solvent. Any of the organic solvents available at all may be used for this reaction on the sole condition that the solvent to be used in incapable of adversely affecting the solution. As concrete examples of the organic solvent, there may be cited nitrobenzene, dichlorobenzene, quinoline, N,N-dimethylformamide, N-methylpyrrolidone, and dimethylsulfoxide. The reaction is generally carried out at a temperature in the range of 150° to 250° C. in the presence of a metal or metal oxide catalyst such as copper powder, copper oxide, or a copper halogenide or a basic catalist such as sodium hydroxide, potassium hydroxide, sodium carbonate, potassium carbonate, sodium hydrogen carbonate, or potassium hydrogen carbonate.

Of the benzidine derivative compounds represented by the aforementioned general formula (2), those which have the substituents $R^5$, $R^6$, $R^7$, $R^8$, $R^9$ and $R^{10}$ attached at regulated positions can be produced, for example, by causing a compound represented by the following general formula (8) to react with compounds represented by the general formulas (4) and (6) thereby producing a compound represented by the general formula (9), then deacylating the compound represented by the general formula (9) by means of hydrolysis thereby producing a compound represented by the general formula (10), and further causing the compound of the general formula (10) to react with compounds represented by the general formulas (5) and (7).

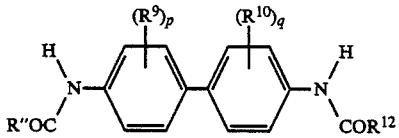

(8)

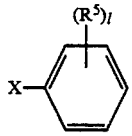

(4)

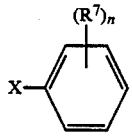

(6)

-continued

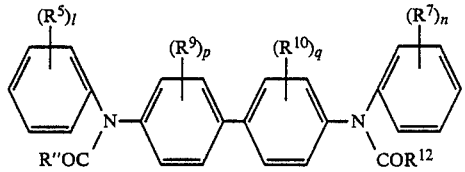

(9)

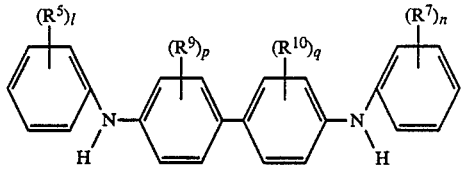

(10)

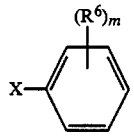

(5)

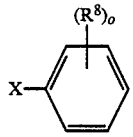

(7)

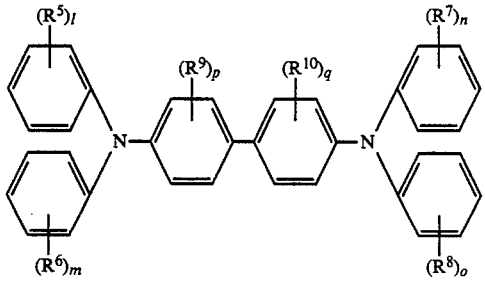

(2a)

(wherein $R^1$ and $R^2$ each stand for a lower alkyl group and $R^5$, $R^6$, $R^7$, $R^8$, $R^9$, $R^{10}$, l, m, n, o, p, q and X have the same meanings as defined above).

The reaction of the compound represented by the aforementioned general formula (8) with the compounds represented by the aforementioned general formulas (4) and (6) can be carried out in the same manner as the reaction of the compound represented by the aforementioned general formula (3) with the compounds represented by the aforementioned general formulas (4) to (7). The reaction for the deacylation of the compound represented by the general formula (9) can be carried out by the conventional method in the presence of a basic catalyst. The reaction of the compound represented by the aforementioned general formula (10) with the compounds represented by the general formulas (5) and (7) can be carried out in the same manner as the reaction of the compound represented by the aforementioned general formula (3) with the compounds represented by the general formulas (4) to (7).

Of the benzidine derivatives represented by the aforementioned general formula (2), those compounds whose substituents $R^5$, $R^6$, $R^7$, $R^8$, $R^9$ and $R^{10}$ are invariable halogen atoms may be produced by causing a compound represented by the aforementioned general formula (10) to react with compounds represented by the general formulas (5) and (7) and subsequently halogenating the resultant reaction product.

After the reaction is completed, the reaction mixture is concentrated. Optionally, the concentrated reaction mixture may be further separated and purified by any of the conventional means such as recrystallization, extraction from a solvent, and column chromatography.

The sensitive material is produced with high sensitivity and low residual potential by preparing a photosensitive layer using a benzidine derivative represented by the aforementioned general formula (2) in combination with a pyrrolopyrrole type compound represented by the aforementioned general formula (1). These reactants, when necessary, may be used further in combination with other electric charge transferring material in a ratio incapable of impairing the charging property and the photosensitive property. As concrete examples of the other electric charge transferring material usable herein, there may be cited tetracyanoethylene, fluorenone type compounds such as 2,4,7-trinitro-9-fluorenone, nitrated compounds such as 2,4,8-trinitrothioxanthone and dinitroanthracene, succinic anhydride, maleic anhydride, dibromomaleic anhydride, oxadiazole type compounds such as 2,5-di(4-dimethylaminophenyl)-1,3,4-oxadiazole, styryl type compounds such as 9-(4-diethylaminostyryl)anthracene, carbazole type compounds such as polyvinyl carbazole, pyrazoline type compounds such as 1-phenyl-3-(p-dimethylaminophenyl)pyrazoline, amine derivatives such as 4,4',4''-tris(4-diethylaminophenyl)triphenylamine, conjugate type compounds such as 1,1-diphenyl-4,4-bis(4-dimethylaminophenyl)-1,3-butadiene, hydrazone type compounds such as 4-(N,N-diethylamino)benzaldehyde-N,N-diphenyl hydrazone, nitrogen-containing cyclic compounds such as indole type compounds, oxazole type compounds, isooxazole type compounds, thiazole type compounds, thiadiazole type compounds, imidazole type compounds, pyrazole type compounds, and triazole type compounds, and condensed polycyclic compounds. In the photoconductive polymers cited as electric charge transferring materials above, poly-N-vinyl carbazole, for example, may be used as a binding resin.

The photosensitive layer may incorporate therein various additives such as the conventional sensitizes represented by terphenyl, halonaphthoquinones, and acenaphtylene, quenchers represented by fluorene type compounds like 9-(N,N-diphenylhydrazino)fluorene and 9-carbazolyliminofluorene, plasticizer, and deterioration inhibitors represented by antioxidant and ultraviolet absorbent.

The photosensitive layer containing a pyrrolopyrrole type compound as an electric charge generating material represented by the aforementioned general formula (1) and a benzidine derivative as electric charge transferring material represented by the aforementioned general formula (2) may be either a single layer type photosensitive layer containing the pyrrolopyrrole type compound represented by the aforementioned general formula (1), the benzidine derivative represented by the aforementioned general formula (2), and a binding resin or a laminate type photosensitive layer composed of an electric charge generating layer containing the pyrrolopyrrole type compound represented by the aforementioned general formula (1) and an electric charge transferring layer containing the benzidine derivative represented by the aforementioned general formula (2) and a binding resin. The construction of the laminate type photosensitive layer is either such that the electric charge transferring layer is superposed on the electric charge generating layer or such that the electric charge generating layer is superposed on the electric charge transferring layer.

A wide variety of binding resins are available for the use mentioned above. The binding resins useful herein include styrene type polymers, acryl type polymers, styrene-acryl type copolymers, olefin type polymers such as polyethylene, ethylene-vinyl acetate copolymers, chlorinated polyethylene, polypropylene, and ionomers, polyvinyl chloride, vinyl chloride-vinyl acetate copolymers, polyesters, alkyd resins, polyamides, polyurethanes, epoxy resins, polycarbonates, polyallylates, polysulfones, diallylphthalate resins, silicone resins, ketone resins, polyvinyl butyral resins, polyether resins, phenol resins, photosetting resins such as epoxy acrylates, and various polymers, for example. These binding resins may be used either singly or jointly in the form of a mixture of two or more members.

In the formation of the single layer type photosensitive layer, the mixing ratio of the pyrrolopyrrole type compounds represented by the general formula (1) and the benzidine derivative represented by the general formula (2) is not specifically restricted but may be suitably selected to fit the properties the electrophotographic selective material is desired to possess. The proportion of the pyrrolopyrrole type compound is desired to be in the range of 2 to 20 parts by weight, preferably 3 to 15 parts by weight, and that of the benzidine derivative in the range of 40 to 200 parts by weight, preferably 50 to 100 parts by weight, based on 100 parts by weight of the binding resin. If the amounts of the pyrrolopyrrole type compound and the benzidine derivative are less than the lower limits of their ranges mentioned above, the sensitive material suffers from insufficient sensitivity and unduly high residual potential. If these amounts exceed the upper limits of their range, the sensitive material is deficient in wear resistance.

The single layer type photosensitive layer may be formed in a suitable thickness. This thickness is desired to be in the range of 10 to 50 μm, preferably 15 to 25 μm.

The electric charge generating layer of the laminate type photosensitive layer may be formed of a film obtained by vacuum depositing or spattering a pyrrolopyrrole type compound represented by the aforementioned general formula (1). In the case of the electric charge generating layer which is formed in combination with a binding resin, the mixing ratio of the pyrrolopyrrole type compound and the binding resin in the electric charge generating layer may be suitably selected. Generally the proportion of the pyrrolopyrrole type compound is desired to be in the range of 5 to 500 parts by weight, preferably 10 to 250 parts by weight, based on 100 parts by weight of the binding resin. If the amount of the pyrrolopyrrole type compound is less than 5 parts by weight, there ensues a disadvantage that the electric charge generating layer is deficient in electric charging capacity. If this amount exceeds 500 parts by weight, there arises a disadvantage that the electric charge generating layer suffers from inferior tightness of adhesion.

The electric charge generating layer may be formed in a suitable thickness. This thickness is desired to be approximately in the range of 0.01 to 3 μm, preferably 0.1 to 2 μm.

In the formation of the electric charge transferring layer, the mixing ratio of the binding resin and the benzidine derivative represented by the general formula (2)

may be suitably selected. The proportion of the benzidine derivative is desired to be in the range of 10 to 500 parts by weight, preferably 25 to 200 parts by weight, based on 100 parts by weight of the binding resin. If the amount of the benzidine derivative is less than 10 parts by weight, the electric charge transferring layer is deficient in electric charge transferring capacity. If this amount exceeds 500 parts by weight, the electric charge transferring layer suffers from poor mechanical strength.

The electric charge transferring layer may be formed in a suitable thickness. This thickness is desired to be approximately in the range of 2 to 100 μm, preferably 5 to 30 μm.

The electric charge generating layer may contain the aforementioned benzidine derivative as an electric charge transferring material in addition to the pyrrolopyrrole type compound as an electric charge generating material. In this case, the mixing ratio of the pyrrolopyrrole type compound, the benzidine derivative, and the binding resin may be suitable selected. This mixing ratio is desired to be similar to that of the pyrrolopyrrole type compound, the benzidine derivative, and the binding resin in the aforementioned single layer type photosensitive layer. The electric charge generating layer may be formed in a suitable thickness. Generally, this thickness is approximately in the range of 0.1 to 50 μm.

The single layer type photosensitive layer can be formed by preparing a photosensitive layer coating liquid containing the aforementioned pyrrolopyrrole type compound, the aforementioned benzidine derivative, and the aforementioned binding resin, applying this coating liquid to the aforementioned electroconductive substrate, and drying or setting the applied layer of the coating liquid.

The laminate type photosensitive layer can be formed by preparing an electric charge generating layer coating liquid containing the aforementioned pyrrolopyrrole type compound, the aforementioned binding resin, etc. and an electric charge transferring layer coating liquid containing the aforementioned benzidine derivative, the aforementioned binding resin, etc., applying the coating liquids sequentially to the electroconductive substrate, and drying or setting the applied layers of the coating liquids.

In the preparation of the coating liquids mentioned above, a varying kind of organic solvent selected to suit the particular kind of binding resin to be adopted may be used. The organic solvents useful herein include aliphatic hydrocarbons such as n-hexane, octane, and cyclohexane; aromatic hydrocarbons such as benzene, toluene, and xylene; halogenated hydrocarbons such as dichloromethane, dichloroethane, carbon tetrachloride, and chlorobenzene; ethers such as dimethyl ether, diethyl ether, tetrahydrofuran, ethylene glycol dimethyl ether, ethylene glycol diethyl ether, and diethylene glycol dimethyl ether; ketones such as acetone, methylethyl ketone and cyclohexanone; esters such as ethyl acetate and methyl acetate; dimethyl formamide; and dimethyl sulfoxide, for example. These organic solvents may be used either singly or jointly in the form of one or more members. Further in the preparation of the coating liquids mentioned above, a surfactant, a leveling agent, etc. may be added for the purpose of enhancing dispersibility and coating property.

The coating liquids can be prepared by the conventional method using a mixing device such as, for example, a mixer, a ball mill, a paint shaker, a sand mill, an attriter, or an ultrasonic dispersion device. The electrophotographic sensitive material contemplated by the present invention can be obtained by sequentially applying the coating liquids to the aforementioned electroconductive substrate and thereafter heating the applied layers of the coating liquid to expel the solvent.

Optionally, for the purpose of enhancing the tightness of adhesion between the aforementioned electroconductive substrate and the photosensitive layer, an undercoating layer may be formed between the electroconductive substrate and the photosensitive layer. In this case, the undercoating layer is formed by applying to a given surface a solution containing a natural or synthetic macromolecule in an amount calculated to form a dry film approximately 0.01 to 1 μm in thickness.

For the purpose of enhancing the tightness of adhesion between the electroconductive substrate and the photosensitive layer, the electroconductive substrate may be treated with a surface treating agent such as, for example, a silane coupling agent or a titanium coupling agent.

Then, for the purpose of protecting the aforementioned photosensitive layer, a surface protecting layer may be formed on the photosensitive layer. The surface protecting layer is formed by preparing a mixed liquid consisting of various binding resins mentioned above or of a binding resin and additives such as a deterioration preventing agent and applying to a given surface this mixed liquid in an amount calculated to produce a dry layer 0.1 to 10 μm in thickness. Preferably, this thickness is approximately in the range of 0.2 to 5 μm.

The electrophotographic sensitive material of the present invention excels in stability to withstand light and in sensitivity and enjoys high surface potential because the photosensitive layer thereof contains a pyrrolopyrrole type compound represented by the aforementioned general formula (1) and a benzidine derivative represented by the aforementioned general formula (2). The electrophotographic sensitive material of the present invention, therefore, can be used advantageously in a copying machine, a laser beam printer, etc.

DETAILED DESCRIPTION OF THE EMBODIMENTS

Now, the present invention will be described more specifically below with reference to working examples.

Electrophotographic sensitive materials possessed of a laminated type photosensitive layer were produced as follows, using various pyrrolopyrrole type compounds and various benzidine derivatives shown in the foregoing table.

Pyrrolopyrrole type compounds

The pyrrolopyrrole type compounds mentioned above are identified by the following symbols in Tables 1 to 3.

A: 1,4-Dithioketo-3,6-diphenylpyrrolo[3,4-c]pyrrole
B: 1,4-Dithioketo-3,6-di(4-tolyl)pyrrolo[3,4-c]pyrrole
C: 1,4-Dithioketo-3,6-di(4-methoxyphenyl)pyrrolo[3,4-c]pyrrole
D: 1,4-Diketo-3,6-diethylpyrrolo[3,4-c]pyrrole
E: N,N'-Diethyl-1,4-dithioketo-3,6-di-tert-butylpyrrolo[3,4-c]pyrrole
F: 1,4-Dithioketo-3,6-distearylpyrrolo[3,4-c]pyrrole
G: N,N'-Dimethyl-1,4-dithioketo-3,6-dibenzylpyrrolo[3,4-c]pyrrole
M: 1,4-Dithioketo-3,6-dinaphthylpyrrolo[3,4-c]pyrrole I: 1,4-Dithioketo-3,6-di(4-pyridyl)pyrrolo[3,4-c]pyrrole
J: N,N'-Diethyl-1,4-dithioketo-3,6-di(2-quinolyl)pyrrolo[3,4-c]pyrrole
K: N,N'-Diethyl-1,4-dithioketo-3,6-di(4-chlorophenyl)-pyrrolo[3,4-c]pyrrole
L: 1,4-Dithioketo-3,6-di[4-(2,2,2-trifluoroethyl)phenyl]-pyrrolo[3,4-c]pyrrole
M: 1,4-Dithioketo-3,6-di(4-diethylaminophenyl)pyrrolo[3,4-c]pyrrole
N: N,N'-Dimethyl-1,4-dithioketo-3,6-di(4-hexyloxy-phenyl)pyrrolo[3,4-c]pyrrole
C: 1,4-Dithioketo-3,6-di(4-cyanophenyl)pyrrolo[3,4-c]pyrrole
P: 1,4-Dithioketo-3,6-di(2-bromophenyl)pyrrolo[3,4-c]pyrrole
Q: N,N'-Diethyl-1,4-dithioketo-3,6-di(4-dodecyl-phenyl)pyrrolo[3,4-c]pyrrole

EXAMPLE 1 to 22

An electric charge generating layer coating liquid consisting of 2parts by weight of a varying pyrrolo-pyrrole type compound indicated above, 1 part by weight of a vinyl chloride-vinyl acetate copolymer (produced by Sekisui Chemical Co., Ltd. and marketed under trademark designation of "S-lec C"), and 10.7 parts by weight of tetrahydrofuran was prepared, applied to an aluminum sheet, and heated at a temperature of 100° C. for 30 minutes to produce an electric charge generating layer about 0.5 μm in thickness.

Then, an electric charge transferring layer was formed using a varying benzidine derivative identified by Compound No. in the preceding table as an electric charge transferring material. Specifically, an electric charge transferring layer coating liquid was prepared by mixing and dissolving 8 parts by weight of a varying compound indicated in Tables 1 to 3, 10 parts by weight of a bisphenol Z type polycarbonate (produced by Mitsubishi Gas Chemical Industries Ltd. and marketed under product code of "PCZ"), and 90 parts by weight of benzene. The coating liquid was applied to the aforementioned electric charge generating layer and dried by heating to form an electric charge transferring layer about 25 μm in thickness. Thus, there was produced an electrophotographic sensitive material possessed of a laminate type photosensitive layer.

COMPARATIVE EXAMPLE 1

An electrophotographic sensitive material possessed of a laminate type photosensitive layer was obtained by following the procedure of Example 1, except that N-ethyl-3-carbazolylaldehyde-N,N-diphenyl hydrazone (described as Compound I hereinafter) was used in the place of the benzidine derivative.

COMPARATIVE EXAMPLE 2

An electrophotographic sensitive material possessed of a laminate type photosensitive layer was obtained by following the procedure of Example 2, except that β type metal-free phtalocyanine (produced by BASF and marketed under trademark designation of "Heliogen Blue-7800") and 4-styryl-4'-methoxytriphenylamine (described as Compound II hereinafter) were used in the place of the pyrrolopyrrole type compound and the benzidine derivative.

COMPARATIVE EXAMPLE 3

An electrophotographic sensitive material possessed of a laminate type photosensitive layer was obtained by following the procedure of Example 3, except that β type metal-free phthalocyanine (produced by BASF and marketed under trademark designation of "Heliogen Blue-7800") and 4-(3,5-dimethylstyryl-4'-methyltriphenylamine (described as Compound III hereinafter) were used in the place of the pyrrolopyrrole type compound and the benzidine derivative.

COMPARATIVE EXAMPLES 4–10

An electrophotographic sensitive material possessed of a laminate type sensitive layer was obtained by following the procedure of Example 1, except that each aromatic amine indicated by the following IV–X was used in the place of the benzidine derivative of Example 1.

| | Compound |
|---|---|
| IV | 4-(N,N-diethylamino)benzaldehyde-N, N-diphenylhydrazon |
| V | di[2-methyl-4-(diethylamino)phenyl]-phenyl-methane |
| VI | 1-phenyl-3-(p-diethylaminophenylvinylene)-5-(p-diethylaminophenyl)pyrazoline |
| VII | 4,4'-(N-phenyl-N-ethylamino)biphenyl |
| VIII | triphenylamine |
| IX | 2,5-di(4-diethylaminophenyl)-1,3,4-oxadiazole |
| X | polyvinylcarbazole. |

To test for charging property and sensitive property, the electrophotographic sensitive materials obtained in Examples 1 to 22 and Comparative Examples 1–10 were each negatively charged by exposure to corona discharge generated under the condition of −6.0 KV in an electrostatic test copier (produced by Kawaguchi Denki K. K. and marketed under product code of "SP-428"). The initial surface potential, V s.p. (V), of each electrophotographic sensitive material was measured and, at the same time, the surface of the sensitive material was exposed to the light from a tungsten lamp of 10 luxes to clock the time required for the aforementioned surface potential, V s.p., to decrease to ½ the initial magnitude and calculated the half-life exposure, E ½ (uJ/cm$^2$). The surface potential measured on elapse of 0.15 second following the exposure was reported as residual potential, V r.p. (V).

The results of the test of the electrophotographic sensitive materials of Examples 1 to 22 and Comparative Examples 1–10 for charging property and sensitive property are shown in Tables 1 to 3.

TABLE 1

| | Pyrrolo-pyrrole type compound | Compound No. | E ½ (μJ/cm$^2$) | Vs. p. (V) | Vr. p. (V) |
|---|---|---|---|---|---|
| Example 1 | A | 2 | 9.75 | −689 | −23 |
| Example 2 | A | 10 | 7.24 | −680 | −18 |
| Example 3 | A | 22 | 7.45 | −678 | −26 |
| Example 4 | A | 80 | 7.31 | −773 | −16 |
| Example 5 | A | 158 | 7.45 | −670 | −26 |
| Example 6 | B | 3 | 8.32 | −695 | −20 |
| Example 7 | C | 6 | 9.81 | −688 | −22 |
| Example 8 | D | 9 | 8.27 | −678 | −18 |
| Example 9 | E | 12 | 8.51 | −692 | −24 |
| Example 10 | F | 15 | 9.71 | −703 | −22 |

TABLE 2

| | Pyrrolo-pyrrole type compound | Compound No. | E ½ (μJ/cm$^2$) | Vs. p. (V) | Vr. p. (V) |
|---|---|---|---|---|---|
| Example 11 | G | 19 | 9.27 | −710 | −19 |
| Example 12 | H | 30 | 8.67 | −682 | −20 |

TABLE 2-continued

| | Pyrrolo-pyrrole type compound | Compound No. | E ½ (μJ/cm²) | Vs. p. (V) | Vr. p. (V) |
|---|---|---|---|---|---|
| Example 13 | I | 38 | 9.85 | −679 | −18 |
| Example 14 | J | 50 | 8.12 | −684 | −17 |
| Example 15 | K | 74 | 8.76 | −692 | −21 |
| Example 16 | L | 77 | 9.81 | −680 | −18 |
| Example 17 | M | 82 | 9.67 | −669 | −17 |
| Example 18 | N | 148 | 8.92 | −682 | −25 |
| Example 19 | O | 154 | 8.60 | −690 | −23 |
| Example 20 | P | 156 | 7.52 | −684 | −18 |

TABLE 3

| | Pyrrolo-pyrrole type compound | Compound No. | E ½ (μJ/cm²) | Vs. p. (V) | Vr. p. (V) |
|---|---|---|---|---|---|
| Example 21 | Q | 198 | 8.09 | −698 | −24 |
| Example 22 | A | 233 | 6.73 | −782 | −13 |
| Comparative Example 1 | A | I | 15.33 | −736 | −52 |
| Comparative Example 2 | — | II | 19.81 | −693 | −62 |
| Comparative Example 3 | — | III | 18.63 | −684 | −52 |
| Comparative Example 4 | A | IV | 17.23 | −725 | −68 |
| Comparative Example 5 | A | V | 16.84 | −713 | −72 |
| Comparative Example 6 | A | VI | 20.51 | −729 | −75 |
| Comparative Example 7 | A | VII | 26.33 | −698 | −98 |
| Comparative Example 8 | A | VIII | 30.28 | −707 | −120 |
| Comparative Example 9 | A | IX | 23.16 | −716 | −76 |
| Comparative Example 10 | A | X | 25.47 | −710 | −103 |

It is noted from Tables 1 to 3, the electrophotographic sensitive materials of Comparative Examples 1–10 were invariably low in sensitivity and high in residual potential. In contrast, the electrophotographic sensitive materials of Examples 1 to 22 were invariably high in sensitivity and low in residual potential.

The test has demonstrated that the electrophotographic sensitive material of Example 22 particularly excelled in charging property and sensitivity and, at the same time, possessed very low residual potential.

The high sensitivity of the electrophotographic sensitive material of Example 22 may be explained by the following reasons (1) to (3).

(1) Since the ionization potential (IP) of No. 233 (4,4-bis[N-(2,4-dimethylphenyl-N-phenylamino]diphenyl) which is 5.43 eV is smaller that of A (1,4-dithioketo-3,6-diphenylpyrrolo[3,4-c]pyrrole) which is 5.46 eV, the injection of holes from A into No. 233 encounters no energy barrier. As the result, the injection of holes is carried out efficiently.

(2) Since the difference between the IP of A and that of No. 233 is as small as 0.03 eV, the possibility of A's IP surface level existing between the IP of A and that of No. 233 is very low even if A has an IP surface level (the IP level originating in the irregularity of molecular configuration on the surface of A existing as microcrystals). As the result, the holes are quickly injected from A into No. 233 without being trapped in route.

(3) Since the difference between the IP of A and that of No. 233 is very slight as mentioned above, the energy (Gibbs free energy difference, ΔG) radiated from A during the injection of holes from A into No. 233 is small. Otherwise, the surrounding binding resin, for example, generates electric dipoles on exposure to the radiated energy. The electric dipoles are oriented in the holes (cationic radicals) injected into No. 233 to help stabilize the holes. Thus, the possibility of the intermolecular transfer of holes in No. 233 being impeded by the stabilization of holes is extremely low.

EXAMPLES 23–33

A photosensitive layer coating liquid was prepared by mixing and dispersing with ball mill for 24 hours 8 parts by weight of a varying pyrrolopyrrole type compound indicated above, 100 parts by weight of benzidine derivative described as Compound No. in Tables aforementioned, 100 parts by weight of a bisphenol Z type polycarbonate (produced by Mitsubishi Gas Chemical Industries Ltd. and marketed under product code of "PCZ"), and 900 parts by weight of dichrolomethane. The coating liquid was applied to an aluminum sheet and dried by heating at a temperature of 100° C. for 30 minutes to produce a single type photosensitive layer of about 18 μm in thickness. Thus, there was produced an electrophotographic sensitive material.

COMPARATIVE EXAMPLES 11–12

An electrophotographic sensitive material possessed of a single layer type photosensitive layer was obtained by following the procedure of Example 23, except that Compounds IV and V aforementioned respectively were used in the place of the benzidine derivative.

The electrophotographic sensitive materials obtained in Examples 23–33 and Comparative Examples 11–12 for charging property and sensitive property are examined by following the procedure of Examples 1–22. The results of the test are shown in Table 4.

TABLE 4

| | Pyrrolo-pyrrole type compound | Compound No. | E ½ (μJ/cm²) | Vs. p. (V) | Vr. p. (V) |
|---|---|---|---|---|---|
| Example 23 | A | 233 | 7.33 | +726 | +47 |
| Example 24 | A | 2 | 8.77 | +716 | +55 |
| Example 25 | A | 4 | 9.12 | +730 | +63 |
| Example 26 | A | 23 | 8.98 | +718 | +58 |
| Example 27 | A | 38 | 9.26 | +700 | +68 |
| Example 28 | A | 79 | 9.45 | +698 | +72 |
| Example 29 | B | 233 | 7.92 | +710 | +53 |
| Example 30 | C | 2 | 8.69 | +720 | +57 |
| Example 31 | D | 23 | 9.61 | +731 | +67 |
| Example 32 | E | 79 | 8.84 | +725 | +65 |
| Example 33 | F | 233 | 8.22 | +705 | +69 |
| Comparative Example 11 | A | IV | 16.57 | +701 | +85 |
| Comparative Example 12 | A | V | 17.21 | +729 | +93 |

It is noted from Table 4 that the electrophotographic sensitive materials of Comparative Examples 11–12 were invariably low in sensitivity and high in residual potential. In contrast, the electrophotographic sensitive materials of Examples 23–33 were invariably high in sensitivity and low in residual potential.

As described above, the electrophotographic sensitive material of the present invention enjoys high sensitivity and low residual potential because the photosensitive layer thereof contains a pyrrolopyrrole type compound represented by the aforementioned general formula (1) and a benzidine derivative represented by the aforementioned general formula (2).

What is claimed is:

1. An electrophotographic sensitive material having a photosensitive layer formed on an electroconductive substrate, and said photosensitive layer contains a pyrrolopyrrole type compound represented by the following general formula (1) and a benzidine derivative represented by the following general formula (2)

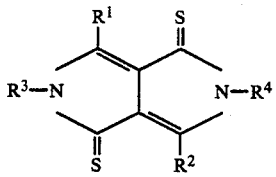

(1)

(wherein $R^1$ and $R^2$ are same or different, selected from the group consisting of aryl group, aryl group which contains a substituent, aralkyl group, aralkyl group which contains a substituent and heterocyclic group, and $R^3$ and $R^4$ are same or different, selected from the group consisting of hydrogen atom, alkyl group, aryl group and aryl group which contains a substituent)

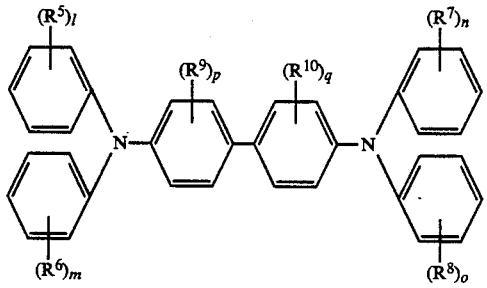

(2)

(wherein $R^5$, $R^6$, $R^7$, $R^8$,$R^9$, and $R^{10}$ are same or different, selected from the group consisting of hydrogen atom, lower alkyl group, lower alkoxy group and halogen atom, l, m, n and o are integers in the range of 1 to 3, and p and q are 1 or 2).

2. An electrophotographic sensitive material according to claim 1, wherein said photosensitive layer is a single type photosensitive layer which contains said pyrrolopyrrole type compound and said benzidine derivative.

3. An electrophotographic sensitive material according to claim 1, wherein said photosensitive layer is a laminate type photosensitive layer superposing an electric charge generating layer which contains said pyrrolopyrrole type compound upon an electric charge transferring layer which contains said benzidine derivative.

4. An electrophotographic sensitive material according to claim 1, wherein said $R^1$ and $R^2$ are aryl group or aralkyl group containing a substituent which is selected from the group consisting of halogen atom, lower alkyl group containing halogen atom, cyano group, alkyl group, alkoxy group and dialkylamino group.

5. An electrophotographic sensitive material according to claim 1, wherein said $R^3$ and $R^4$ are hydrogen atom, alkyl group of 1 to 4 carbon atoms or phenyl group which has a substituent selected from the group consisting of halogen atom, lower alkyl group containing halogen atom, alkyl group, alkoxy group, alkylthio group and nitro group.

6. An electrophotographic sensitive material according to claim 1, wherein $R^5$, $R^6$, $R^7$, $R^8$, $R^9$ and $R^{10}$ are same or different, selected from the group consisting of hydrogen atom, alkyl group of 1 to 4 carbon atoms, alkoxy group of 1 to 4 carbon atoms and halogen atom.

7. An electrophotographic sensitive material according to claim 1, wherein $R^1$ and $R^2$ are each a phenyl group, and $R^3$ and $R^4$ are each a hydrogen atom.

8. An electrophotographic sensitive material according to claim 1, wherein $R^5$, $R^7$, $R^9$ and $R^{10}$ are each a hydrogen atom, and

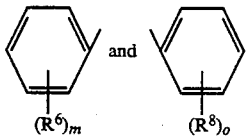

are each a 2,4-dimethylphenyl group.

9. An electrophotographic sensitive material according to claim 1, wherein $R^1$ and $R^2$ are each a phenyl group, $R^3$ and $R^4$ are each a hydrogen atom, $R^5$, $R^7$, $R^9$ and $R^{10}$ are each a hydrogen atom, and

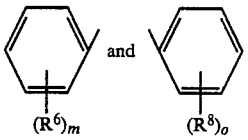

are each a 2,4-dimethylphenyl group.

10. An electrophotographic sensitive material according to claim 2, wherein the pyrrolopyrrole type compound is in the range of 2 to 20 parts by weight and the benzidine derivative is in the range of 40 to 200 parts by weight based on 100 parts by weight of binder.

11. An electrophotographic sensitive material according to claim 3, wherein the electric charge generating layer of the laminate contains 5 to 500 parts pyrrolopyrrole type compound in a binder based on 100 parts by weight of binder, and the electric charge transferring layer contains 10 to 500 parts by weight benzidine derivative in a binder, based on 100 parts by weight of binder.

12. An electrophotographic sensitive material having a photosensitive layer formed on an electroconductive substrate, and said photosensitive layer contains a pyrrolopyrrole type compound represented by the following formula (1) and a benzidine derivative represented by the following general formula (2)

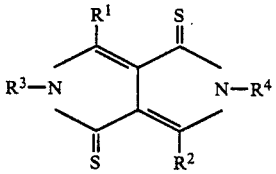

(1)

wherein $R^1$ and $R^2$ are same or different, selected from the group consisting of aryl group, aryl group which contains a substituent, aralkyl group, aralkyl group which contains a substituent and heterocyclic group, and $R^3$ and $R^4$ are same or alkyl group, aryl group and aryl group which contains a substituent

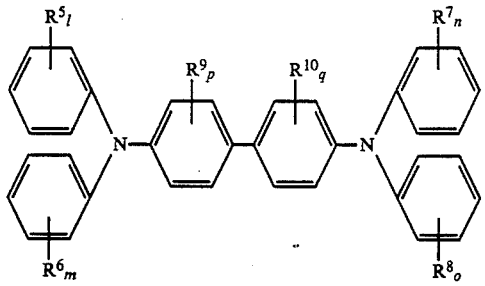

(2)

wherein $R^5$, $R^6$, $R^7$, $R^8$, $R^9$ and $R^{10}$ are same or different, selected from the group consisting of hydrogen atom, lower alkyl group, lower alkoxy group and halogen atom, l, m, n and o are integers in the range of 1 to 3, and p and q are 1 or 2, wherein said photosensitive layer is a member selected from the group consisting of a single type photosensitive layer which contains said pyrrolopyrrole type compound and said benzidine derivative and a laminate type photosensitive layer superposing an electric charge generating layer which contains said pyrrolopyrrole type compound upon an electric charge transferring layer which contains said benzidine derivative, and in the single type photosensitive layer the pyrrolopyrrole type compound is in the range of 2 to 20 parts by weight and the benzidine derivative is in the range of 40 to 200 parts by weight based on 100 parts by weight of binder, and wherein the electric charge generating layer of the laminate contains 5 to 500 parts pyrrolopyrrole type compound in a binder based on 100 parts by weight of binder, and the electric charge transferring layer contains 10 to 500 parts by weight benzidine derivative in a binder, based on 100 parts by weight of binder.

* * * * *

UNITED STATES PATENT AND TRADEMARK OFFICE

CERTIFICATE OF CORRECTION

PATENT NO. : 4,925,759

DATED : May 15, 1990

INVENTOR(S) : HANATANI et al.

It is certified that error appears in the above-identified patent and that said Letters Patent is hereby corrected as shown below:

Column 33, line 1, after "or" insert -- different, selected from the group consisting of hydrogen atom, --

Signed and Sealed this

Third Day of March, 1992

*Attest:*

HARRY F. MANBECK, JR.

*Attesting Officer*

*Commissioner of Patents and Trademarks*